US011148927B2

(12) United States Patent
Wing et al.

(10) Patent No.: US 11,148,927 B2
(45) Date of Patent: Oct. 19, 2021

(54) BEVERAGE DISPENSING

(71) Applicant: Hydration Labs, Inc., Boston, MA (US)

(72) Inventors: Michael Wing, Quincy, MA (US); Michael Peterson, Boston, MA (US); Kent Walters, Revere, MA (US); Elizabeth Becton, Charlestown, MA (US); Sean Grundy, New York, NY (US); Yvan De Boeck, Medford, MA (US); Joseph Brumaghim, Windham, NH (US); Matthew Howard Dorson, Arlington, MA (US)

(73) Assignee: Hydration Labs, Inc., Boston, MA (US)

( * ) Notice: Subject to any disclaimer, the term of this patent is extended or adjusted under 35 U.S.C. 154(b) by 0 days.

(21) Appl. No.: 16/047,254

(22) Filed: Jul. 27, 2018

(65) Prior Publication Data

US 2020/0031654 A1 Jan. 30, 2020

(51) Int. Cl.

| | |
|---|---|
| ***B67D 1/00*** | (2006.01) |
| ***B67D 1/08*** | (2006.01) |
| ***B67D 1/16*** | (2006.01) |

(52) U.S. Cl.

CPC ..... *B67D 1/0878* (2013.01); *B67D 1/0015* (2013.01); *B67D 1/0057* (2013.01); *B67D 1/16* (2013.01); *B67D 2001/0096* (2013.01)

(58) Field of Classification Search

CPC ..... Y10T 137/8766; Y10T 137/87676; Y10T 137/8326; B67D 1/0016; B67D 1/0021;

(Continued)

(56) References Cited

U.S. PATENT DOCUMENTS 3,256,802 A 6/1966 Karr
3,397,871 A 8/1968 Hasselberg (Continued)

FOREIGN PATENT DOCUMENTS

CN 101855657 10/2010
CN 102791613 11/2012

(Continued)

OTHER PUBLICATIONS

Transaction History for U.S. Appl. No. 15/971,780, downloaded Aug. 27, 2018, pp. 1.

(Continued)

*Primary Examiner* — Charles P. Cheyney
(74) *Attorney, Agent, or Firm* — Adam J. Thompson; Daniel Huynh

(57) ABSTRACT

Among other things, a chiller for chilling water to be dispensed as part of beverages includes a tank configured to contain a cooling mass for chilling the water. A first tube in the tank is configured to be immersed in the cooling mass and to carry the water along a path from a source towards a location where the chilled water is to be dispensed as part of the beverages. A second tube is configured to be immersed in the cooling mass and to carry a coolant along a recirculation path from a coolant source and back to the coolant source. The coolant has a sufficiently low temperature to cause a frozen mass to be formed as part of the cooling mass within the tank and in the vicinity of the second tube. The first tube and the second tube are configured and positioned relative to one another within the tank so that the frozen mass occupies at least 30 percent of the volume of the cooling mass in the tank but does not touch the first tube.

13 Claims, 23 Drawing Sheets

(58) Field of Classification Search
CPC ..... B67D 2210/0001; B67D 1/0022; B67D 1/0027; B67D 1/0028; B67D 1/0031; B67D 1/0032; B67D 1/0014; G01F 23/00–0046; G01F 23/0076; G01F 1/34
USPC ..... 222/129.1, 129.4, 146.6; 73/195–204.27, 73/861–861.69
See application file for complete search history.

(56) References Cited

U.S. PATENT DOCUMENTS 3,777,937 A 12/1973 Buck
4,128,190 A 12/1978 Gruber
4,392,588 A 7/1983 Scalera
4,955,507 A 9/1990 Kirschner et al.
4,979,639 A 12/1990 Hoover et al.
5,129,434 A 7/1992 Whigham et al.
5,193,746 A * 3/1993 Iwamura ..... B05B 15/525 239/109
5,279,446 A 1/1994 Cook et al.
5,427,682 A * 6/1995 Vogel ..... B01D 61/08 210/257.2
5,491,617 A 2/1996 Currie
5,510,060 A 4/1996 Knoll
5,526,959 A 6/1996 Green
5,839,291 A 11/1998 Chang
5,845,824 A 12/1998 Weimer et al.
5,881,911 A 3/1999 Burdette et al.
5,930,771 A 7/1999 Stapp
5,988,441 A 11/1999 Weinaug et al.
5,992,685 A 11/1999 Credle, Jr.
6,199,720 B1 3/2001 Rudick et al.
6,230,150 B1 5/2001 Walker et al.
6,234,354 B1 5/2001 Phillips et al.
6,302,299 B1 10/2001 Baker et al.
6,364,159 B1 * 4/2002 Newman ..... B67D 1/0028 222/1
6,425,226 B1 7/2002 Kirschner
6,431,950 B1 8/2002 Mayes
6,504,481 B2 1/2003 Teller
6,547,100 B2 4/2003 Phillips et al.
6,556,889 B2 4/2003 Rudick et al.
6,616,037 B2 9/2003 Grimm et al.
6,807,460 B2 10/2004 Black et al.
6,962,270 B1 8/2005 Barker et al.
7,020,680 B2 3/2006 Defosse
7,218,991 B2 5/2007 Walker et al.
7,445,133 B2 11/2008 Ludovissie et al.
7,499,762 B2 3/2009 Khorramshahi
7,553,076 B2 6/2009 An
7,573,395 B2 8/2009 Morrison et al.
7,577,496 B2 8/2009 Walker et al.
7,587,333 B1 9/2009 Walker et al.
7,627,496 B2 12/2009 Walker et al.
7,726,562 B2 6/2010 Walker et al.
7,739,181 B2 6/2010 Breitenbach et al.
7,757,896 B2 7/2010 Carpenter et al.
7,826,923 B2 11/2010 Walker et al.
7,865,265 B2 1/2011 Walker et al.
7,894,936 B2 2/2011 Walker et al.
7,912,580 B2 3/2011 Walker et al.
7,912,581 B2 3/2011 Walker et al.
7,913,879 B2 3/2011 Carpenter et al.
7,972,639 B2 7/2011 Guerrero et al.
8,001,795 B2 8/2011 Pfister et al.
8,068,933 B2 11/2011 Walker et al.
8,079,495 B2 12/2011 Bethuy et al.
8,140,185 B2 3/2012 Simmons et al.
8,162,176 B2 4/2012 Rudick
8,162,181 B2 4/2012 Carpenter et al.
8,191,779 B2 6/2012 Illingworth et al.
8,234,207 B2 7/2012 Breitenbach et al.
8,328,050 B2 12/2012 Ziesel
8,458,312 B2 6/2013 Raghunathan et al.
8,590,746 B2 11/2013 Bethuy et al.
8,596,529 B1 12/2013 Kolls
8,631,974 B2 1/2014 Piatnik et al.
8,642,051 B2 2/2014 Stillman
8,666,874 B2 3/2014 Breitenbach et al.
8,744,618 B2 6/2014 Peters et al.
8,751,037 B2 6/2014 Peters et al.
9,399,570 B2 7/2016 van Haperen et al.
2003/0012864 A1 1/2003 Gerber
2003/0121937 A1 7/2003 Black et al.
2004/0118291 A1 6/2004 Carhuff
2005/0121466 A1 6/2005 Sher et al.
2005/0133531 A1 6/2005 Crisp, III et al.
2005/0276035 A1 12/2005 Currie
2006/0097008 A1 5/2006 Emmendoerfer et al.
2007/0130965 A1 * 6/2007 Boarman ..... F25D 23/126 62/135
2007/0267441 A1 11/2007 Van Opstal et al.
2008/0202148 A1 8/2008 Gagliano
2009/0065570 A1 3/2009 Peters et al.
2010/0213212 A1 8/2010 Custodis et al.
2011/0049187 A1 3/2011 Boekhoom et al.
2011/0181417 A1 7/2011 Haskayne et al.
2011/0192495 A1 8/2011 Deo et al.
2011/0315711 A1 12/2011 Hecht et al.
2012/0104021 A1 * 5/2012 Cur ..... F25D 23/126 62/389
2012/0104028 A1 5/2012 Bortoletto et al.
2012/0114814 A1 5/2012 Bippert
2012/0325845 A1 12/2012 Newman et al.
2012/0325846 A1 12/2012 Reddy et al.
2013/0106690 A1 5/2013 Lim
2013/0233888 A1 * 9/2013 Kim ..... F25D 23/126 222/173
2013/0309361 A1 * 11/2013 Kyong ..... B67D 1/12 426/67
2014/0097549 A1 4/2014 Hoare et al.
2014/0107835 A1 4/2014 Biasi et al.
2014/0352805 A1 * 12/2014 Kuebeck ..... B61D 35/00 137/347
2015/0102062 A1 4/2015 Mosimann et al.
2015/0232320 A1 8/2015 Wait et al.
2015/0239724 A1 8/2015 Cronise
2015/0191341 A1 9/2015 Martindale et al.
2016/0009539 A1 1/2016 Jersey et al.
2016/0130131 A1 * 5/2016 Hitzelberger ..... B67D 1/0014 141/69
2016/0223251 A1 * 8/2016 Yun ..... F25D 23/028
2016/0255991 A1 8/2016 Givens, Jr. et al.
2017/0043992 A1 2/2017 Green
2017/0088410 A1 * 3/2017 Wing ..... B67D 1/0022
2017/0186079 A1 * 6/2017 Kim ..... G06F 3/0488
2017/0233234 A1 8/2017 Hecht et al.
2017/0241701 A1 * 8/2017 Lee ..... B01F 3/04106
2017/0297891 A1 * 10/2017 Ko ..... F25D 23/126
2018/0045442 A1 * 2/2018 Park ..... F25D 25/005
2018/0132507 A1 5/2018 Siegel et al.
2018/0251358 A1 9/2018 Wing et al.
2018/0251359 A1 9/2018 Wing et al.
2018/0251360 A1 9/2018 Wing et al.
2018/0251361 A1 9/2018 Wing et al.
2019/0231119 A1 * 8/2019 Kennedy ..... A47J 31/0642
2020/0182534 A1 * 6/2020 Scalf ..... G01F 23/24

FOREIGN PATENT DOCUMENTS

EP 0873966 10/1998
WO WO 2009/032686 A1 3/2009
WO WO 2012/161936 A1 11/2012
WO WO2015/022692 2/2015
WO WO2017/059027 4/2017

OTHER PUBLICATIONS

Transaction History for U.S. Appl. No. 15/971,880, downloaded Aug. 27, 2018, pp. 1.
Transaction History for U.S. Appl. No. 15/971,897, downloaded Aug. 27, 2018, pp. 1.

(56) References Cited

OTHER PUBLICATIONS

Transaction History for U.S. Appl. No. 15/280,293, downloaded Aug. 27, 2018, pp. 1.
Transaction History for U.S. Appl. No. 15/971,890, downloaded Aug. 27, 2018, pp. 1.
Application from U.S. Appl. No. 15/280,293 dated Sep. 29, 2016, pp. 1-58.
Application from U.S. Appl. No. 15/971,780, dated May 4, 2018, pp. 1-49.
Application from U.S. Appl. No. 15/971,880, dated May 4, 2018, pp. 1-49.
Application from U.S. Appl. No. 15/971,897, dated May 4, 2018, pp. 1-50.
Application from U.S. Appl. No. 15/971,890, dated May 4, 2018, pp. 1-49.
U.S. Appl. No. 15/280,293, filed Sep. 29, 2016, Wing et al.
U.S. Appl. No. 15/971,780, filed May 4, 2018, Wing et al.
U.S. Appl. No. 15/971,880, filed May 4, 2018, Wing et al.
U.S. Appl. No. 15/971,890, filed May 4, 2018, Wing et al.
U.S. Appl. No. 15/971,897, filed May 4, 2018, Wing et al.
PCT/US2016/054370, Mar. 27, 2017, International Search Report and Written Opinion.
PCT/US2016/054370, Apr. 12, 2018, International Preliminary Report on Patentability.
EP16852569.9, Feb. 27, 2019, Partial Supplementary European Search Report.
EP16852569.9, Jun. 4, 2019, Extended European Search Report.
International Search Report and Written Opinion for International Application No. PCT/US2016/054370, dated Mar. 27, 2017.
International Preliminary Report on Patentability for International Application No. PCT/US2016/054370, dated Apr. 12, 2018.
Partial Supplementary European Search Report for European Application No. 16852569.9, dated Feb. 27, 2019.
Extended European Search Report for European Application No. 16852569.9, dated Jun. 4, 2019.
Examination Report dated Nov. 2, 2020 for United Kingdom patent application No. GB1804610.2.

* cited by examiner

BEVERAGE DISPENSING

BACKGROUND

Some types of beverage dispensers, such as the point-of-use dispensers distributed by Bevi (www.bevi.co), draw water from the tap and use it to dispense drinks on demand to users who can customize the dispensed beverages by selecting certain characteristics such as amount of carbonation, temperature, and flavors. Additional information about such beverage dispensers is included in United States patent application publication 2017/0088410, incorporated here by reference in its entirety.

SUMMARY

In general, in an aspect, a machine-implemented method includes displaying on a display screen of a beverage dispenser touch sensitive icons representing selectable characteristics of a beverage to be dispensed through a nozzle, receiving signals from the display screen representing touch inputs at the icons, and controlling beverage components of the beverage dispenser to cause a beverage to be dispensed through the nozzle, the characteristics of the beverage conforming to the received signals, the selectable characteristics including at least one of temperature, carbonation level, and flavor.

Implementations may include one or a combination of two or more of the following features. The characteristics include temperature and carbonation and the icons represent hot water, still cold water, and carbonated cold water. The characteristics of the beverage to be dispensed can be changed between hot water, still cold, and carbonated cold water essentially as quickly as the touch inputs change. The characteristics include a selectable carbonation level within a continuous range of carbonation levels, the icons represent any carbonation level within the range, and the beverage is dispensed at a selected carbonation level by dispensing still water and carbonated water through the nozzle in a ratio that corresponds to the selected carbonation level. The upper carbonation level includes water that is fully saturated with carbon dioxide. The characteristics include flavor, two or more of the icons represent different flavors, the received signals represent a combination of touch inputs at two or more of the flavor icons, and the beverage is dispensed to have a flavor that is a mix of the two or more flavors based on the combination of touch inputs. The touch inputs occur simultaneously at the two or more flavor icons. The flavors include flavor concentrates and the flavors are dispensed separately at the nozzle and mix as part of the beverage being dispensed.

In general, in an aspect, a machine-implemented method includes, in a beverage dispenser, machine reading an identification of a container of a consumable supply of a component of beverages to be dispensed, sending data representing the machine-read identification through a communication network to a database of a server that also serves other beverage dispensers, receiving from the server a signal to stop usage of the container as a supply of the component, and stopping usage of the container in response to the received signal.

Implementations may include one or a combination of two or more of the following features. The identification includes an RFID tag or a graphical code. The stopping of usage is based on expiration of a shelf life of the consumable supply. The stoppage of usage is based on instruction from the server. The shelf life is timed from when the container is placed in the beverage dispenser. The method of claim including displaying to a user of the beverage dispenser an indication that usage is stopped. The indication includes changing an appearance of an icon on a display screen of the beverage dispenser. The indication includes removing the icon from the display screen.

In general, in an aspect, a machine-implemented method includes, at a server receiving information from a beverage dispenser about usage of consumable held in a container and used as a component of beverages being dispensed, analyzing characteristics of the usage of the consumable, and based on the analysis, taking an action related to usage of the consumable at the beverage dispenser.

Implementations may include one or a combination of two or more of the following features. The analyzing of the characteristics of the usage includes tracking time elapsed after the container was first put into use. The information received from the beverage dispenser includes a time when the container was first put into user. The taking an action includes sending a signal to the beverage dispenser to stop usage of the consumable. The taking an action includes sending the signal based on expiration of the shelf life of the consumable.

In general, in an aspect, a machine-implemented method includes, at a server, receiving data from beverage dispensers related to usage of consumables held in containers in the beverage dispensers and used as components of beverages being dispensed, analyzing the data across the beverage dispensers to determine characteristics of usage of the consumables, and taking an action with respect to the consumables based on the analysis.

Implementations may include one or a combination of two or more of the following features. The analyzing includes determining trends of expirations of the consumables. The analysis includes a comparison of the time of expiration of a consumable in one of the containers to the time at which the container becomes empty of the consumable. The analysis includes maintaining an inventory of all consumables in all containers in all of the beverage dispensers. The analysis includes predicting usage of consumables in containers in the beverage dispensers. The predicting includes predicting usage of consumables by at least one of: a type of consumable, a beverage dispenser, a location, a region, or an arbitrary grouping of consumable containers or beverage dispensers. The taking an action includes causing replacement containers of consumables to be installed in the beverage dispensers. The causing replacement of the containers includes sending the replacements to locations of the beverage dispensers. The causing replacement of the containers includes sending notifications to service providers. The predicting includes predicting seasonal usage. The taking action includes ceasing use of a type of consumable.

In general, in an aspect, a beverage dispenser includes one or more modules configured to receive containers holding consumable supplies to be incorporated into beverages dispensed from a nozzle, one or more of the modules or one or more of the containers or both bearing a machine readable identification, a reader configured to sense the identification, a communication device configured to (a) send information about the containers or the modules and the usage of the consumable supplies through a communication network to a server and (b) receive information from the server about the containers or the modules and the usage of the consumable supplies, and a controller configured to control the usage of the consumable supplies based on the received information.

Implementations may include one or a combination of two or more of the following features. The beverage dispenser of claim can be configured to have four flavors, eight flavors, coffee, ready to drink beverages (such as juice, beer, or wine), or active modules. The beverage dispenser of claim in which the containers held in a given one of the modules hold consumable supplies all are associated with a corresponding class of beverage. The beverage dispenser of claim in which the class of beverage is one of flavored beverages, functional beverages, hot beverages, and alcoholic beverages.

In general, in an aspect, a machine-implemented method includes showing on a display screen of a beverage dispenser, touch-sensitive icons representing characteristics of beverages to be dispensed, receiving information about characteristics that can be imparted to the dispensed beverages at a given time based on consumable supplies or constituents available within the beverage dispenser for inclusion a dispensed beverage, and based on the received information, configuring the displayed touch-sensitive icons to represent the characteristics that can be imparted to the dispensed beverage at the given time.

Implementations may include one or a combination of two or more of the following features. The characteristics include flavors that are available at the given time and the displayed touch-sensitive icons are configured to identify the flavors, one flavor per icon. The characteristic includes hot water and the displayed touch-sensitive icons are configured to identify availability of hot beverages. The characteristic includes carbonation and the displayed touch-sensitive icons are configured to identify availability of carbonated beverages. The characteristic includes which consumable supplies are available for mixing with hot water, for mixing with cold water, or for mixing with carbonated water and the displayed touch-sensitive icons are configured to identify the consumable supplies that are available for the mixing with each type of water. The characteristic includes a non-water-based beverage and the displayed touch-sensitive icons are configured to identify the non-water-based beverages. The characteristic includes mixtures of two or more consumable supplies in a beverage and the displayed touch-sensitive icons are configured to identify the consumable supplies to be mixed. The method of claim including changing an operation of the beverage dispenser based on the received information. The operation includes a rate at which a constituent is incorporated into the dispensed beverage based on the received information. The receiving information about characteristics that can be imparted to the dispensed beverages includes reading information on containers of consumable supplies and fetching from a lookup table dispensing information for the consumable supplies.

In general, in an aspect, a machine-implemented method includes receiving information through a communication network from a beverage dispenser about consumable supplies to be used in beverages dispensed from a nozzle of the beverage dispenser, determining availability states of the consumable supplies based on the received information, sending to the beverage dispenser instructions about the consumable supplies based on the determined availability states of the consumable supplies.

Implementations may include one or a combination of two or more of the following features. The sending to the beverage dispenser instructions about the consumable supplies includes sending instructions to cause the beverage dispenser to change its operational state. The change in operational state includes changes in mixing of consumable supplies to be used in the dispensed beverages. The change in operational state includes changes in ratios of components of the dispensed beverages. The sending to the beverage dispenser instructions about the consumable supplies includes sending instructions to cause a display screen of the beverage dispenser to change an appearance of displayed touch-sensitive icons. The change of appearance of the displayed touch-sensitive icons includes changing an icon from representing a consumable supply that is no longer available to representing a combination of two consumable supplies that remain available. The in which sending to the beverage dispenser instructions about the consumable supplies includes sending instructions to cause a display screen of the beverage dispenser to change characteristics of displayed touch-sensitive icons to alter the relative likelihoods that respective consumable supplies will be used. The changing the characteristics of displayed touch-sensitive icons includes changing the associations of consumable supplies with respective icons based on positions of the icons on the display screen. The method of claim including changing the associations to reflect changes in the availability states of respective consumable supplies.

In general, in an aspect, a chiller for chilling water to be dispensed as part of beverages includes a tank configured to contain a cooling mass for chilling the water. A first tube in the tank is configured to be immersed in the cooling mass and to carry the water along a path from a source towards a location where the chilled water is to be dispensed as part of the beverages. A second tube is configured to be immersed in the cooling mass and to carry a coolant along a recirculation path from a coolant source and back to the coolant source. The coolant has a sufficiently low temperature to cause a frozen mass to be formed as part of the cooling mass within the tank and in the vicinity of the second tube. The first tube and the second tube are configured and positioned relative to one another within the tank so that the frozen mass occupies at least 30 percent of the volume of the cooling mass in the tank but does not touch the first tube.

Implementations may include one or a combination of two or more of the following features. The first tube includes helically wound tubing. The helically wound tubing includes two helically wound sub-coils of tubing. The two helically wound sub-coils of tubing have identical helical configurations. The central axes of the two helically wound sub-coils of tubing are parallel. The second tube includes helically wound tubing. The helically wound tube includes two helically wound sub-coils of tubing. The two helically wound sub-coils of tubing have identical helical configurations. The central axes of the two helically wound sub-coils of tubing are parallel. The first tube and the second tube each include two helically wound sub-coils of tubing having parallel axes projecting vertically into the tank. The sub-coils are supported by a coil spacer and the coil spacers of all four sub-coils have the same configuration. The two helically wound sub-coils each has a free end that is coupled to a corresponding free end of the other helically wound sub-coil to cause the two helically wound sub-coils to form a continuous single tube. A carbonation tank lies within a space defined within the helically wound tubing. An agitator is immersed within the cooling mass and configured to cause circulation of water that is part of the cooling mass. The frozen mass occupies at least 30 percent of the volume of the cooling mass in the tank. The cooling mass includes water.

In general, in an aspect, an apparatus for chilling water to be used in dispensing beverages includes a tank configured to contain a cooling water for chilling the beverage water. A first tube in the tank is configured to be immersed in the cooling water and to carry the beverage water along a path from a source towards a location where the chilled water is to be dispensed. A second tube in the tank is configured to be immersed in the cooling water and to carry a coolant along a recirculation path from a coolant source and back to the coolant source. The coolant has a sufficiently low temperature to cause an ice block to be formed on the second tube and within the cooling water in the tank and not in touch with the first tube. The first tube includes two helically wound sub-coils of tubing held parallel and vertically within the tank. A free end of one of the two helically wound sub-coils is connected to a free end of the other one of the two helically wound sub-coils, Implementations may include one or a combination of two or more of the following features. There is a carbonation tank within a space defined within one of the helically wound sub-coils of the first tube. There is an agitator immersed within the cooling water and configured to cause circulation of the cooling water.

In general, in an aspect, an ice block is formed within a body of cooling water. The ice block includes at least 30 percent of the volume of the cooling water and the ice block combined. Drinking water is chilled by flowing it through a tube immersed in the cooling water. The tube is not in contact with the ice block. The drinking water is dispensed as part of a beverage.

Implementations may include one or a combination of two or more of the following features. The ice block is formed by flowing a coolant through a tube immersed in the cooling water. The ice block is attached to the tube. The cooling water is agitated while the drinking water is chilled. Carbonated water is chilled in a container immersed in the cooling water.

In general, in an aspect, a vessel is configured to contain a volume of chilled water and a volume of CO2 in contact with the volume of water to enable CO2 to dissolve in the water. There are a water inlet and a water outlet on the vessel. A pump is coupled to the water inlet and the water outlet to recirculate chilled water. There is a CO2 inlet on the vessel. A controller starts the pump when a level switch in the carbonation tank detects a decrease in the water level inside the tank and stops the pump no longer than 120 seconds after starting the pump. The controller is configured to permit CO2 to pass from a source through the inlet into the vessel as CO2 dissolves in the water.

In general, in an aspect, a flow rate is set at which carbonated beverages are dispensed at a beverage dispenser. A volume of carbonated beverages is dispensed from the beverage dispenser beginning at a predetermined time based on the flow rate. Based on the determined volume of carbonated beverages dispensed, a fill level is determined of a CO2 tank from which CO2 is drawn for carbonating the beverages dispensed at the beverage dispenser.

Implementations may include one or a combination of two or more of the following features. The flow rate is set by a servicer of the beverage dispenser. When the determined fill level of the CO2 tank crosses a threshold, an alert is provided. The threshold is associated with an empty or nearly empty fill level. The fill level is determined based on an empirically determined relationship between the flow rate at which carbonated beverages are dispensed and the rate at which CO2 is drawn from the CO2 tank.

In general, in an aspect, an end of a dispensing of a beverage is detected. Also detected is how long after the end of the dispensing it takes for a reservoir of water used in the dispensing of the beverage to be replenished. Based on how long it takes for the water reservoir to be replenished, a consumption state is determined of a filter through which the water passes before are used in the dispensing of the beverage.

Implementations may include one or a combination of two or more of the following features. The detecting of how long it takes to replenish the reservoir of water includes detecting changes in water pressure in the supply of water.

In general, in an aspect, water pressure is detected in a reservoir of water that receives water from a building water supply and delivers water for use in dispensing beverages. Also detected is when beverages are not dispensed and water is not resupplied from the building water supply to the reservoir of water to replenish water used in dispensing beverages. When the beverages are not dispensed, the water is not being resupplied, and the water pressure in the reservoir drops below a threshold, an alert is delivered indicative of a water leak.

In general, in an aspect, leaking liquid in a beverage dispensing machine is allowed to accumulate in a tray. When liquid accumulated in the tray rises above a predetermined level, a signal is received from a sensor (e.g., a float switch). In response to the signal from the level switch, the dispensing of any beverages from the machine is stopped.

In general, in an aspect, an interactive user interface of a touch screen of a beverage dispenser is configured to include a set of interactive touch-sensitive controls that enable users to perform operations including to select characteristics of a beverage to be dispensed and to cause the dispensing of the beverage according to the selected characteristics. The use of the beverage dispenser by the users is constrained based on the touch sensitive controls that are included in the interactive user interface until the interactive user interface is reconfigured. The interactive user interface of the touch-screen of the beverage dispenser is reconfigured to include a reconfigurable set of interactive touch-sensitive controls that constrain the use of the beverage dispenser by users in a different way from the constraints of the original interactive user interface until the interactive user interface is again reconfigured.

In general, in an aspect, a nozzle for dispensing beverages that include hot liquids at sometimes and cold liquids at other times has an outlet for dispensing the beverages into beverage containers, a first inlet for cold liquids to be included in beverages to be dispensed, a flow path from the first inlet through the nozzle to the outlet. A diffusion chamber along the flow path diffuses cold liquids flowing along the flow path. A segment of the flow path is downstream of the diffusion chamber. A second inlet for hot liquids to be included in beverages to be dispensed is coupled to insert the hot liquids into the flow path at the downstream segment.

Implementations may include one or a combination of two or more of the following features. The nozzle includes an annular space surrounding the diffusion chamber. The annular space is coupled at one end to the second inlet and at the other end to the downstream segment of the flow path. The downstream end of the diffusion chamber opens into the downstream segment.

In general, in an aspect, a nozzle for dispensing beverages includes an outlet having a vertically oriented central axis for dispensing the beverages into beverage containers. One or more tubes are configured to inject respective additives into a beverage as it flows from the outlet. Each of the tubes has a central axis that intersects the central axis of the outlet. The angle between the central axis of the outlet in the central axis of each of the tubes being in the range of 0 degrees and 90 degrees.

Implementations may include one or a combination of two or more of the following features. The angle between the central axes is in the range of 10 degrees and 30 degrees. The angle between the central axes is 20 degrees. The radial distance between the central axis of the outlet and the central axis of each of the tubes is between 2.5 millimeters and 15.2 millimeters. The radial distance is between 7.6 millimeters and 12.7 millimeters. The radial distance is 10.2 millimeters.

In general, in an aspect, a nozzle for dispensing beverages includes an outlet for dispensing the beverages into beverage containers. There is an inlet for receiving liquids to be included in beverages to be dispensed, a flow path through the nozzle from the inlet to the outlet, and a flow compensator in the nozzle along the flow path.

Implementations may include one or a combination of two or more of the following features. The flow compensator includes a conical member held within a channel of the nozzle between the inlet and the outlet. The conical member is oriented with its smaller end upstream of its larger end. The conical member is seated within a conical chamber having a broader upstream cross-section than the cross-section of the conical member. The conical member includes one or more channels leading from a space between an outer surface of the conical member and an inner surface of the conical chamber toward the outlet of the nozzle.

In general, in an aspect, a nozzle for dispensing beverages includes an outlet for dispensing the beverages in a single stream into beverage containers, a hot water inlet for delivering hot water into the stream, a still water inlet for delivering non-hot still water into the stream, carbonated water inlet for delivering carbonated water in the stream, the hot water inlet, the still water inlet, and the carbonated water inlet being separated from one another in the nozzle.

Implementations may include one or a combination of two or more of the following features. There are features for processing the carbonated water as it enters the stream. The still water inlet opens into the features for processing the carbonated water upstream of the hot water inlet. The hot water inlet is downstream of the carbonated water processing features. There are inlets for delivering respective individual consumable supplies into the stream. The inlets deliver the individual consumable supplies into the stream downstream of the hot water inlet, the still water inlet, and the carbonated water inlet. There is at least one additional outlet for dispensing a pre-mixed beverage.

In general, in an aspect, a machine-implemented method includes, at a server receiving information through a communication network about operations of beverage dispensers at two or more remote locations, each of the beverage dispensers being configured to dispense beverages through a nozzle using water that has been processed in the beverage dispenser, carbon dioxide that has been processed in the beverage dispenser, and consumable supplies in containers installed in the beverage dispenser, storing the received information in a database at the server, analyzing the information stored in the database, and taking an action with respect to the operations of the beverage dispensers based on the analysis.

Implementations may include one or a combination of two or more of the following features. The taking of the action includes monitoring servicing of each of the beverage dispensers. The monitoring of servicing of each of the beverage dispensers includes monitoring at least one of: the timing of the servicing, the identity of people performing the servicing, and changes made to operations of the beverage dispenser by the servicing. The taking of the action includes sending instructions to each of the beverage dispensers to cause adjustment of operating parameters of the beverage dispenser. The causing adjustment of the operating parameters includes adjusting at least one of temperature set points for water and carbonated water. The causing adjustment of the operating parameters includes adjusting rates at which water, carbonated water, and consumable supplies are delivered for inclusion in beverages being dispensed. The causing adjustment of the operating parameters includes adjusting an ice bath temperature set point and a hysteresis band for cooling water. The causing adjustment of the operating parameters includes adjusting a water pump time out period to protect a water pump from running dry when the beverage dispenser is calling for water, but water is unavailable. The causing adjustment of the operating parameters includes adjusting an inlet valve. The adjusting the inlet valve includes adjusting a water inlet valve time out period. The adjusting a threshold rate of change of water pressure for closing an inlet valve. The causing adjustment of the operating parameters includes adjusting a water filter consumption threshold that includes a ratio of time to dispense water for a beverage to time to refill a bladder tank after the water has been dispensed. The causing adjustment of the operating parameters includes adjusting leak detection threshold that includes a water pressure value while the beverage dispenser is in an idle state not dispensing a beverage. The causing adjustment of the operating parameters includes adjusting a water supply shut off detection threshold that includes a water pressure value while the beverage dispenser is dispensing. The causing adjustment of the operating parameters includes adjusting a ratio of an amount of water dispensed and an amount of a consumable supply dispensed based on a formulation of the consumable supply. The taking of the action includes starting or restarting the beverage dispenser. The causing adjustment of the operating parameters includes adjusting a frequency of reading sensors in the beverage dispenser. The taking of the action includes changing the enabled state of at least one of a water pump, an ice bank agitator, a refrigeration system, an inlet solenoid, or an RFID antenna. The taking of the action includes updating software or firmware of the beverage dispenser. The causing adjustment of the operating parameters includes setting a depleted carbon dioxide threshold that includes an amount of carbonated water dispense time with no call for water. The causing adjustment of the operating parameters includes setting a water pump start delay or a water pump end delay that includes a time period between activation of a dispensing solenoid and activation of a water pump. The causing adjustment of the operating parameters includes setting a consumable supply dispense pulsing rate for a pump associated with the consumable supply. The information received about the operations of beverage dispensers includes sensor information about performance of the beverage dispenser. The information about performance includes at least one of the following alarms: leak detect, low water pressure, depleted carbon dioxide, and filter lifetime. The information about performance includes at least one of the following: water pressure, time to dispense carbon dioxide and time to refill a carbonation tank after dispensing, time to dispense water and a time to refill a bladder tank after dispensing water, an ice bath temperature, a refrigeration duty cycle, a reason for open inlet and duration of opening during dispensing or after dispensing, and a time for a water pump to refill a carbonation tank. The analyzing includes diagnosing failures of the beverage dispensers. The analyzing includes predicting timing for replacing or refilling supplies. The predicting includes applying a predictive model to predict when a supply of carbon dioxide will be depleted based on historical data on selections by users of carbonation strengths. The analyzing includes determining consumption rates of a particular type of consumable supply across a group of separate beverage dispensers. The method of claim including generating order forecasts based on the determined consumption rates. The analyzing includes predicting consumable supply usage based on user behavior. The received information includes one or more of the following: time, date, duration, and type of consumable for each dispensing of a beverage at each beverage dispenser. The analyzing includes analyzing one or more of popularity of types of consumable supplies, correlations between preferences for different types of consumable supplies, seasonality of preferences for types of consumable supplies, and regionality of preferences for types of consumable supplies. The taking an action includes controlling functionality based on the types of consumable supplies in use at the beverage dispenser. The taking an action includes controlling access to the beverage dispenser.

In general, in an aspect, a beverage dispenser includes a coupling for connection to a building water supply that supplies water at a pressure, a flow path extending from an upstream end nearer the coupling to a downstream end nearer a nozzle at which beverages are dispensed, and a water pump configured to drive water received at the coupling to the nozzle at a controlled flow rate.

Implementations may include one or a combination of two or more of the following features. The pressure in the building water supply varies. The pressure in the building water supply differs from pressure supplied to other beverage dispensers. The beverage dispenser of claim including a bladder tank along the flow path and configured to reduce the effect of variation in water pressure at the coupling on flow rate of the water at the nozzle. The beverage dispenser of claim including a water filter along the flow path that reduces flow rate over time, the bladder tank configured to reduce the effect of the reduction of flow rate over time on the flow rate of the water at the nozzle. The beverage dispenser of claim including a pressure sensor on the bladder tank and a process configured to measure how long it takes to achieve a predetermined pressure on a downstream side of the filter at a location along the path between the filter and the bladder tank, and a processor configured to determine a remaining filter life based on the length of time. The beverage dispenser of claim in which the pressure sensor is configured to monitor how long it takes for pressure in the bladder tank to return to a predetermined pressure after a beverage is dispensed, and in which the processor is configured to detect a leak based on how long it takes for the pressure to return to the predetermined pressure. The beverage dispenser of claim including a recirculation pump for recirculating carbonated water through a carbonation path to increase carbonation levels in the carbonated water.

These and other aspects, features, and implementations can be expressed as methods, apparatus, systems, components, program products, methods of doing business, means or steps for performing a function, and in other ways.

These and other aspects, features, and implementations will become apparent from the following descriptions, including the claims.

DESCRIPTION

FIGS. 5 through 7, 14, and 22 through 25 are screenshots of user interface displays.

FIGS. 8, 9, 15, 16 and 21 are block diagrams.

Figure 10:
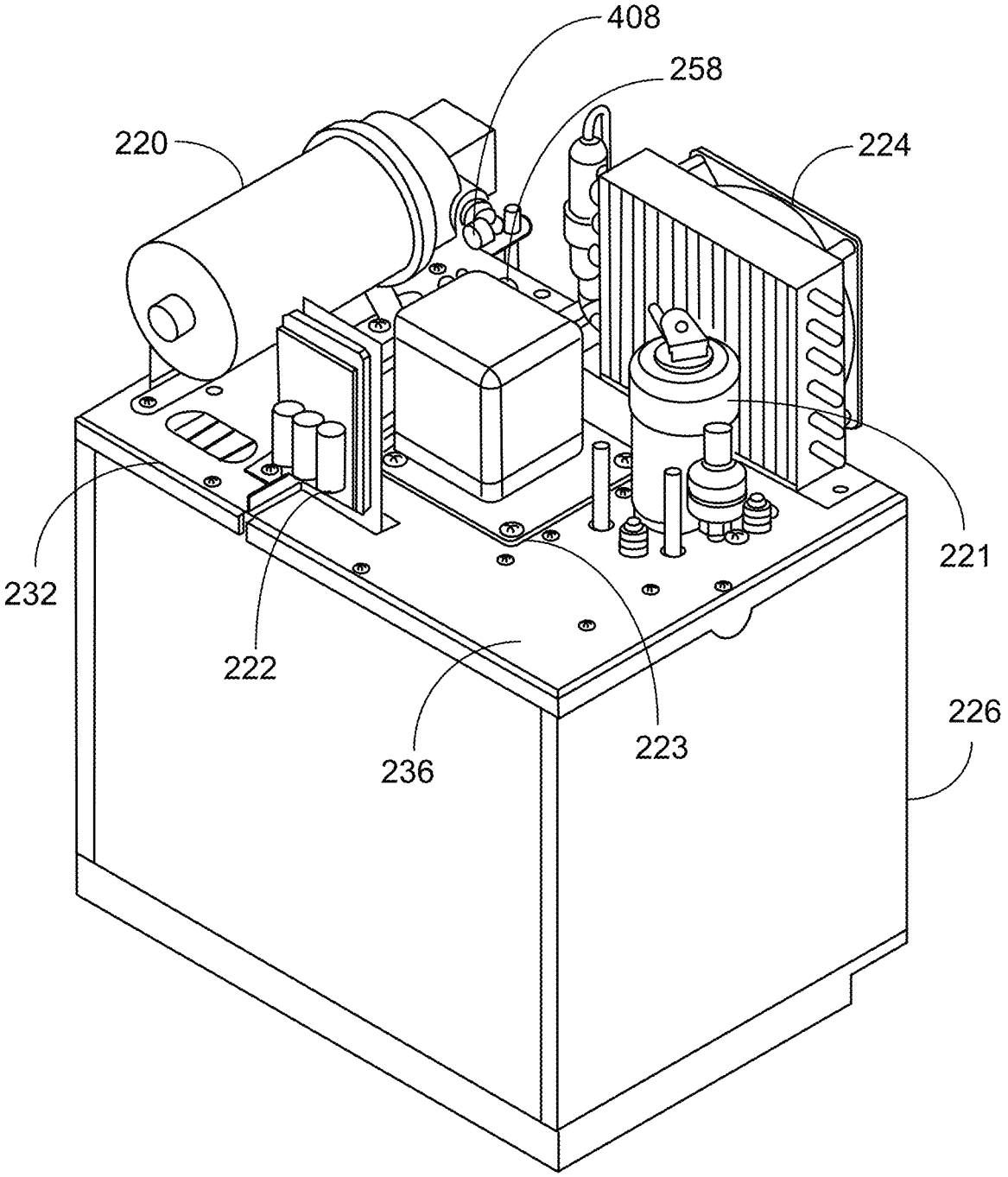

FIG. 10 is a perspective view of a chiller.

Figure 11:
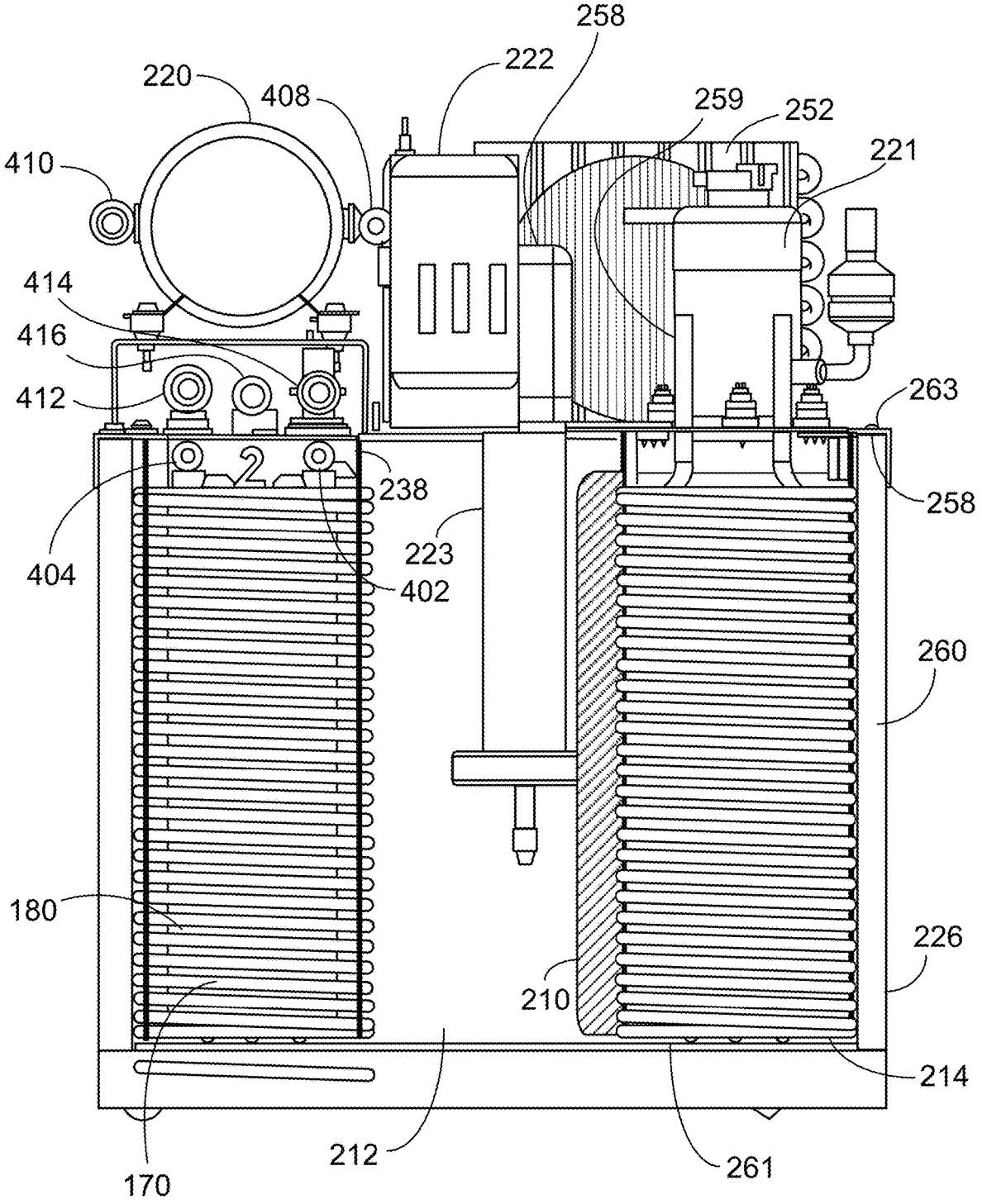

FIG. 11 is a cross-sectional view of a chiller.

Figure 12:
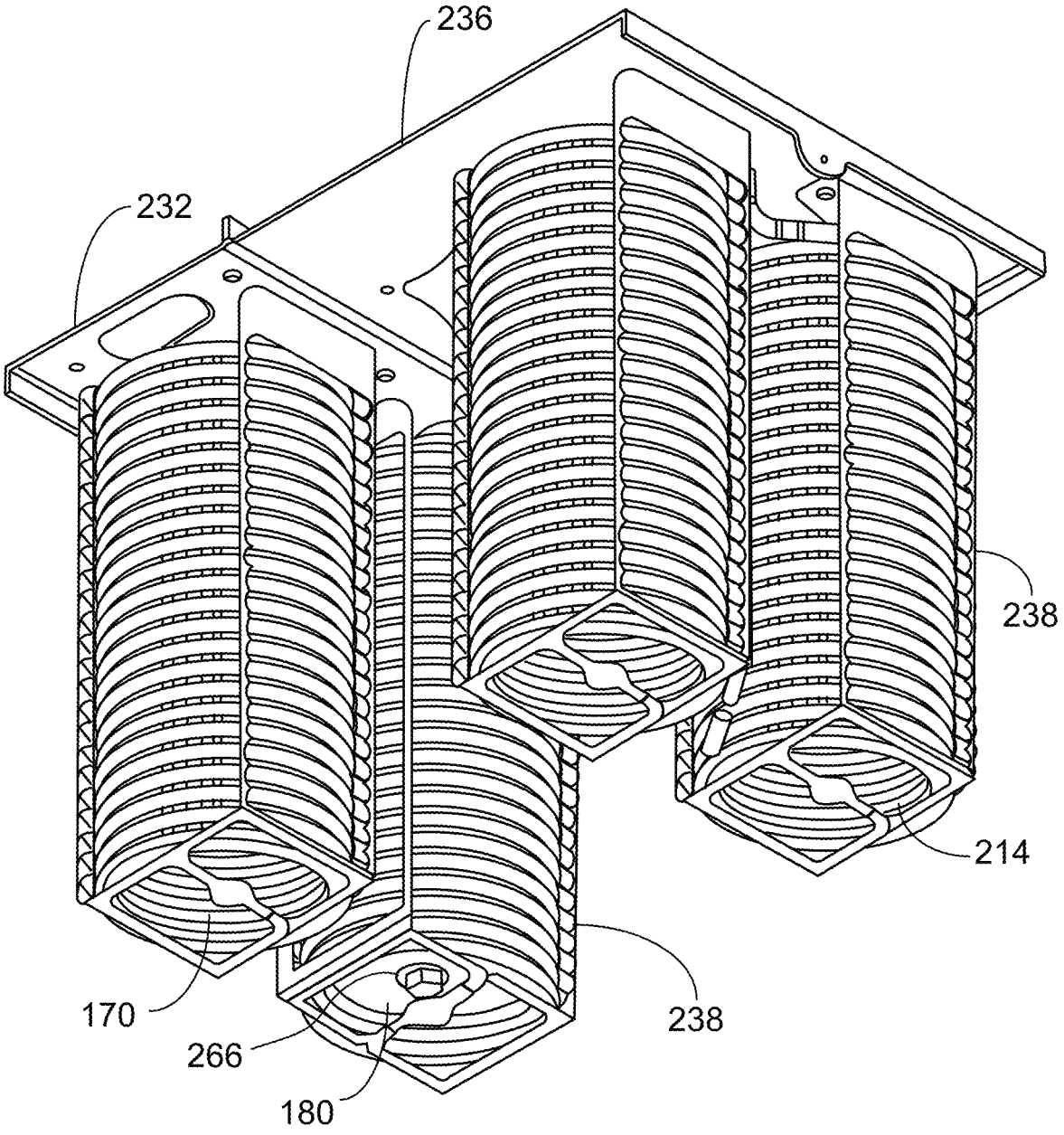

FIG. 12 is a perspective view of coils.

Figure 13:
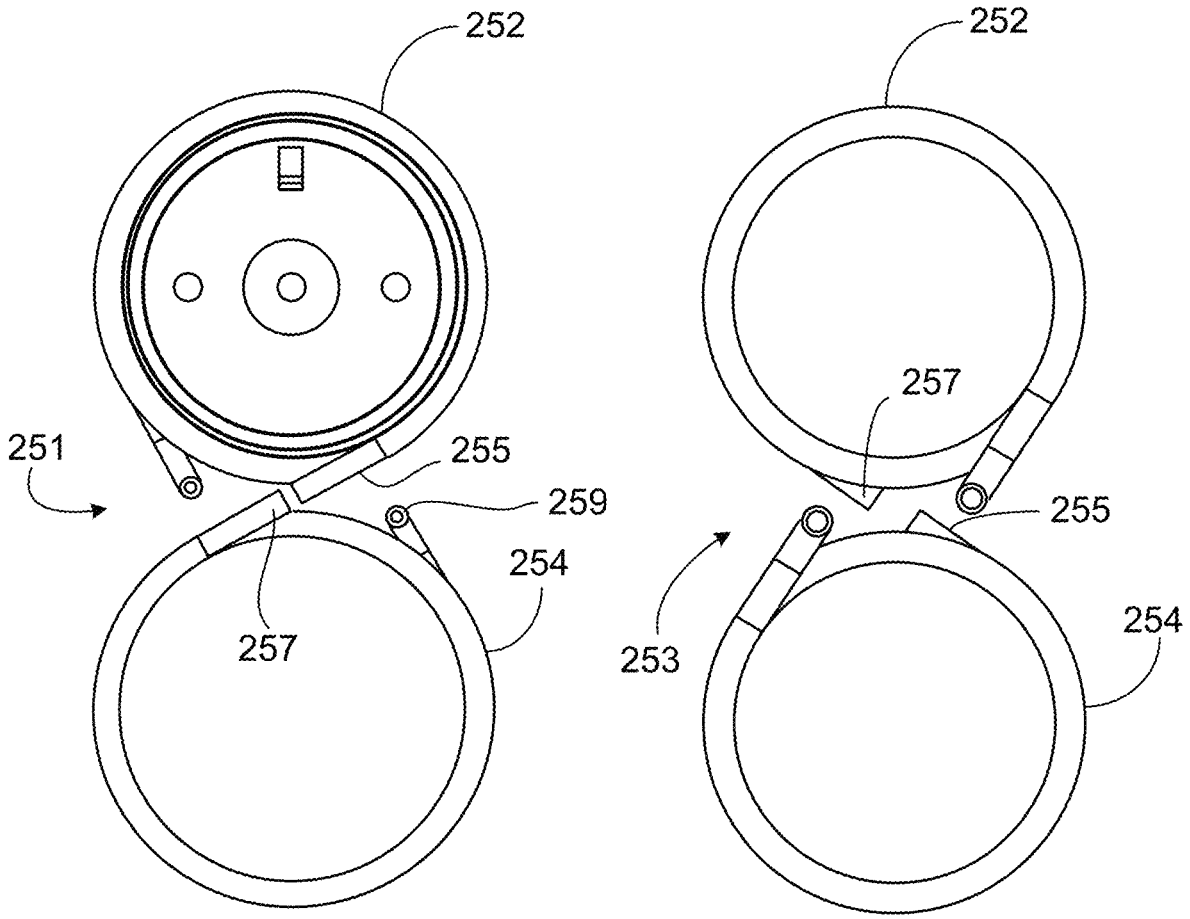

FIG. 13 is a top view of coils.

Figure 17:
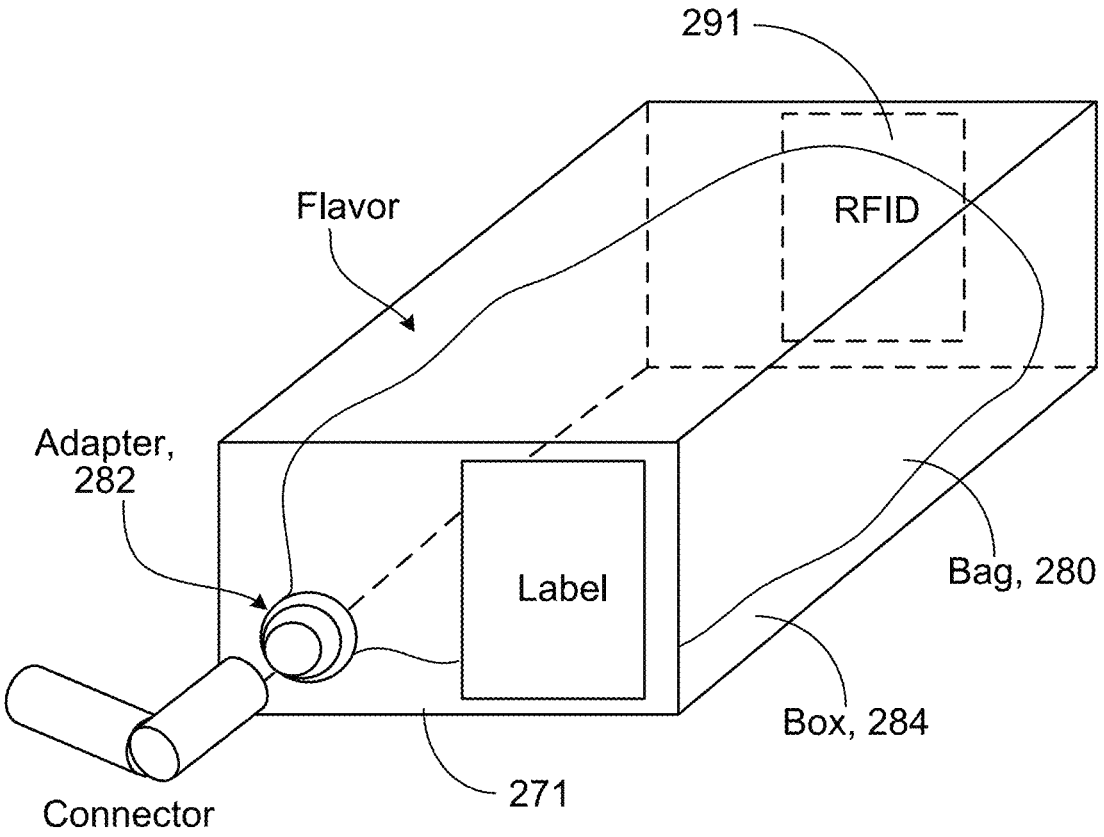

FIG. 17 is a perspective view of a consumable container.

Figure 20:
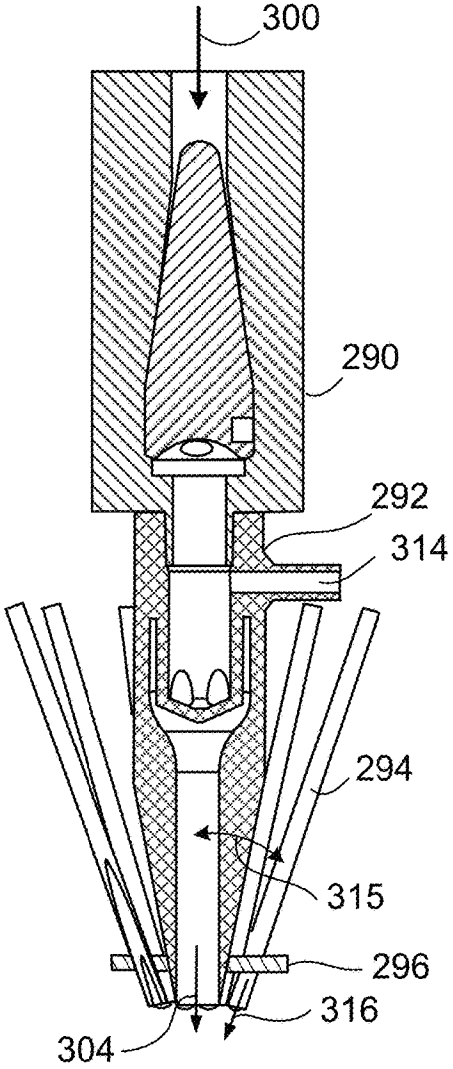
Figure 19:
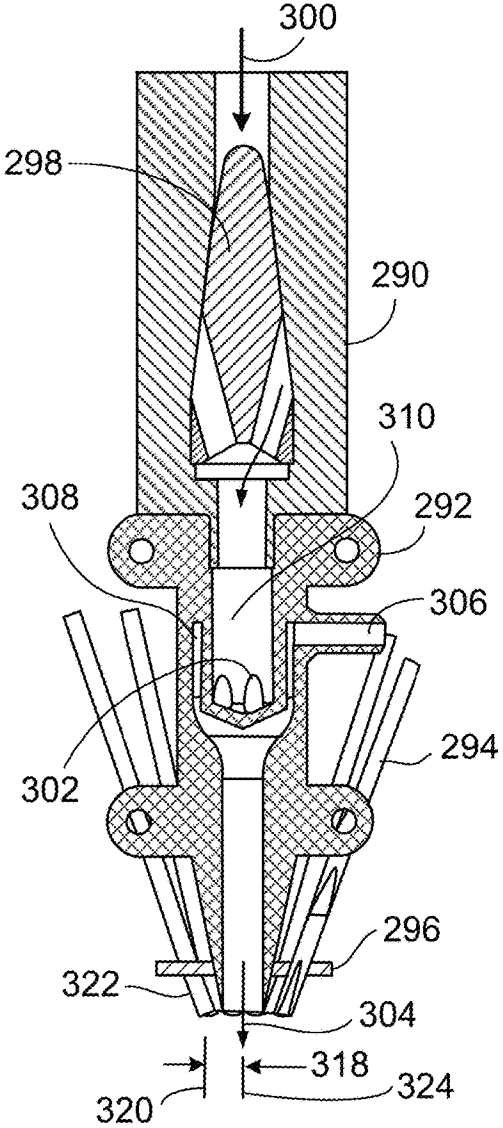
Figure 18:
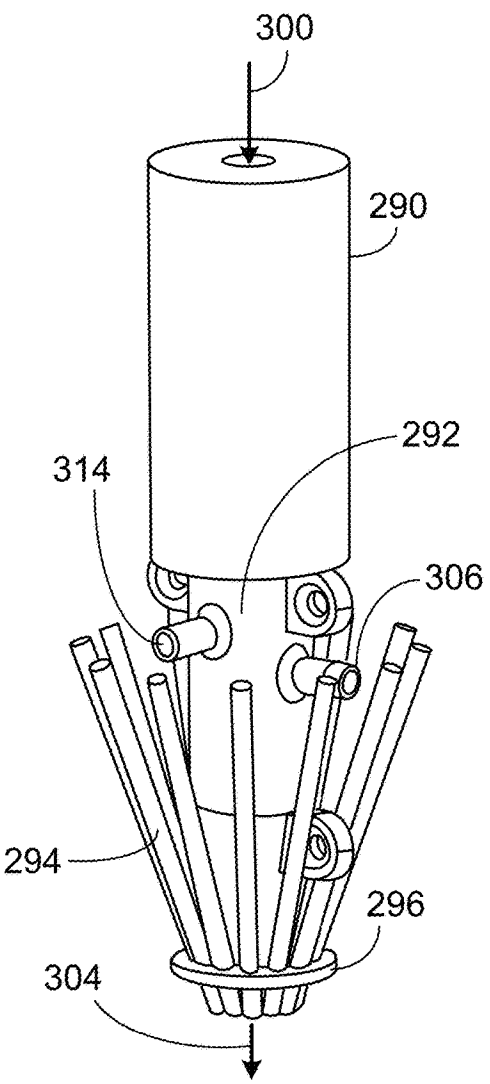

FIGS. 18, 19, and 20 are a perspective view, a front sectional view, and a side sectional view of a nozzle assembly.

Figure 1:
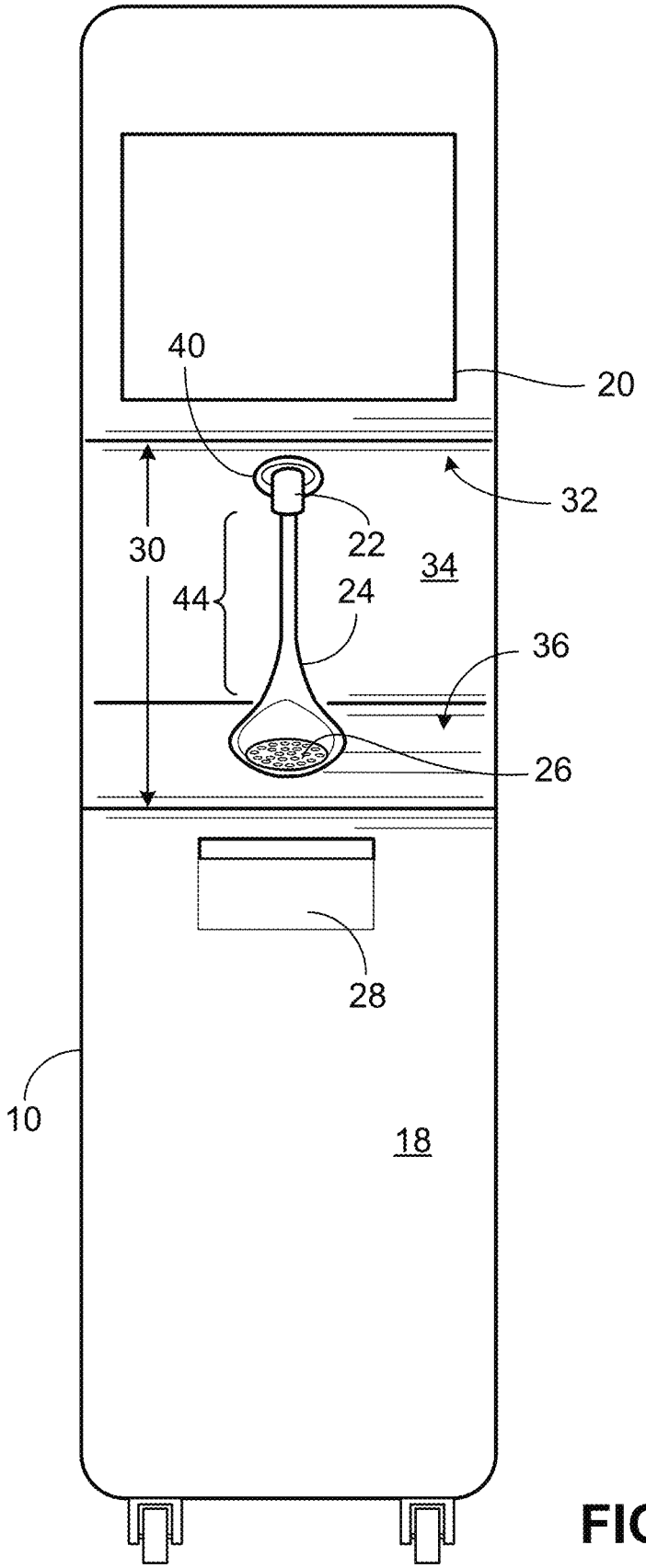
FIG. 1 is a front view of a beverage dispensing machine.
Figure 2:
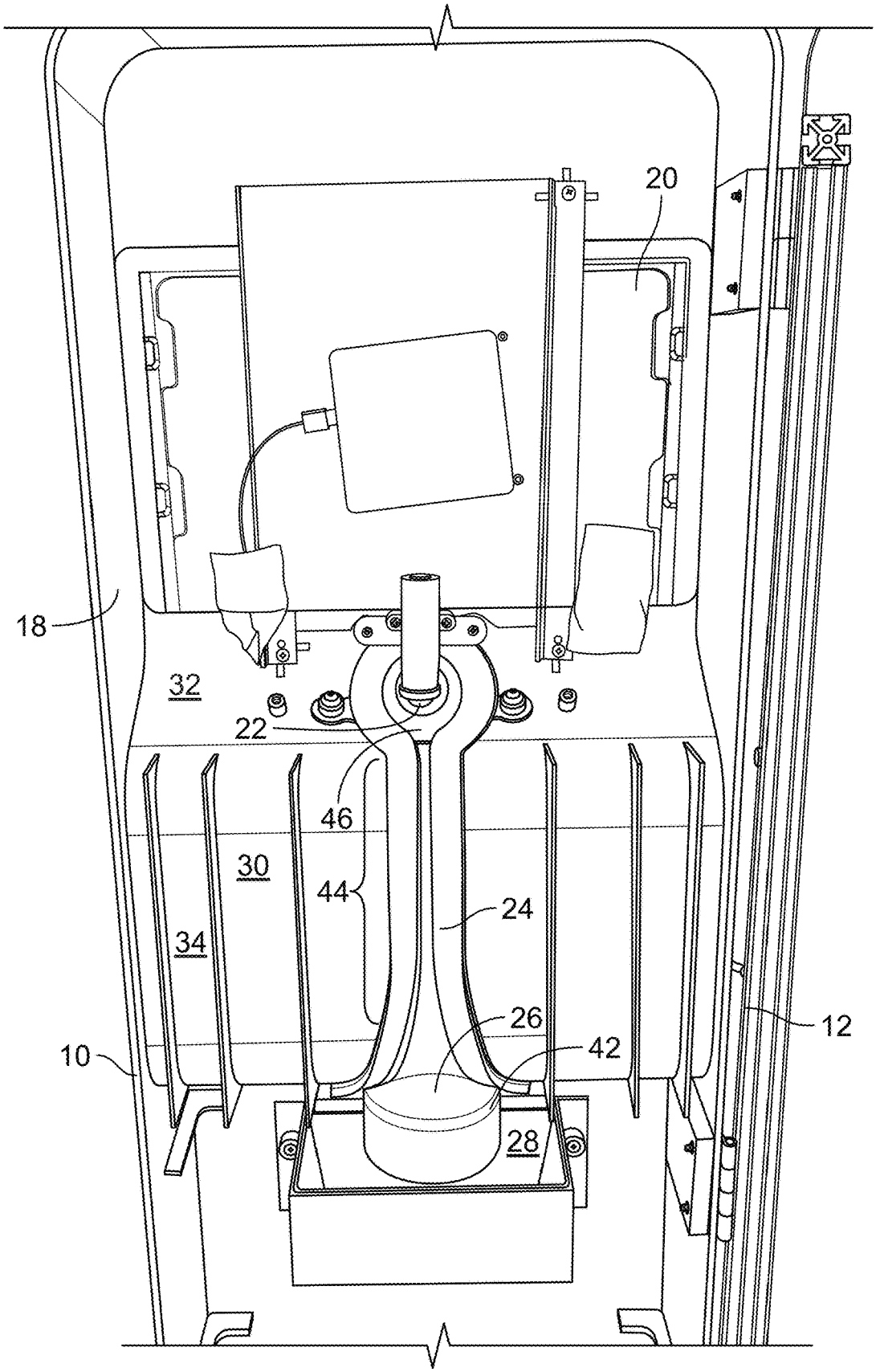
FIG. 2 is a front view of the inside of the front door of a beverage dispensing machines.
Figure 3:
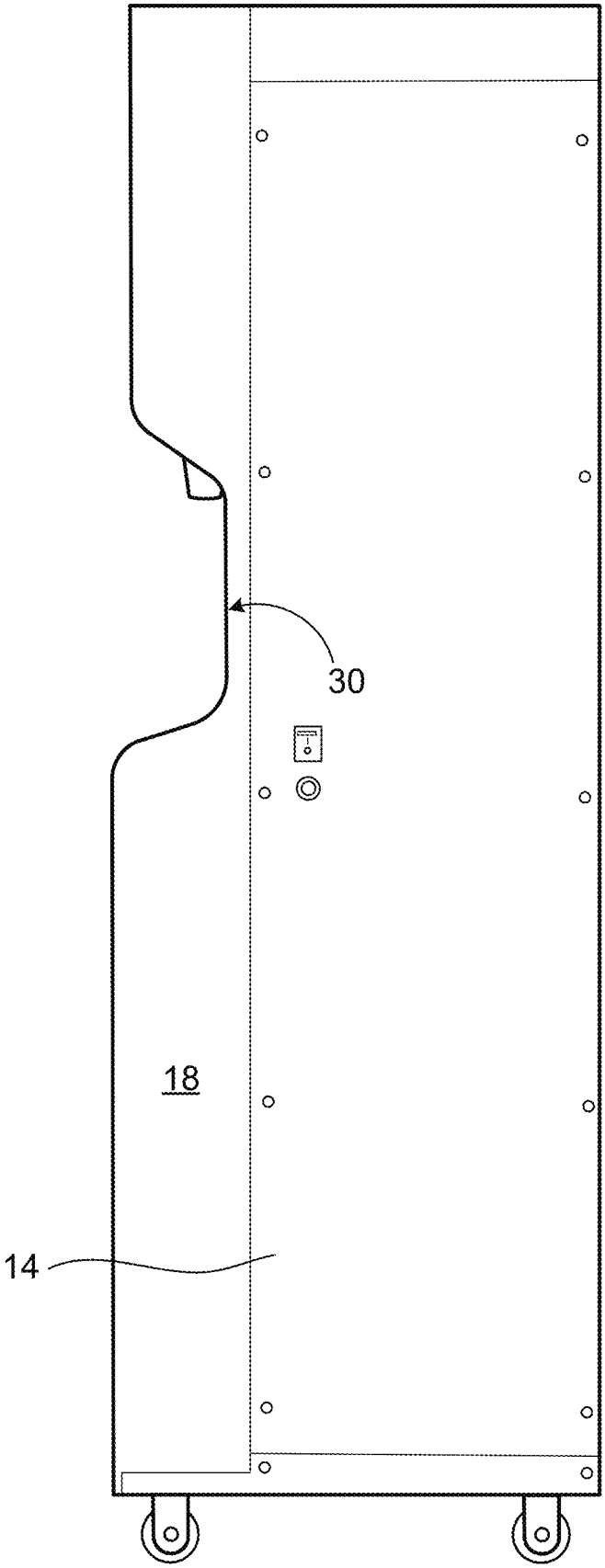
FIG. 3 is a side view of a beverage dispensing machine.

As shown in FIGS. 1, 2, and 3, in some cases parts or all of the technology that we describe here can be implemented in a free-standing beverage dispenser (which we sometimes call "the machine").

In some example implementations discussed here the machine 10 could, for example, be 62" high and have a 16"×20" base although a wide variety of sizes and shapes would be possible, including smaller sizes for tighter spaces. The machine has four wheels (the front two wheels swivel and the back two wheels are rigid) to enable easy transportation. The inside frame 12 of the machine is made with welded steel extrusions and the outside 14 of the machine frame (the sides of the machine) is made with powder-coated steel. Blue vinyl in water-color patterns along the outside gives the machine a distinctive look. Viewed from the front, the machine has curved edges (as opposed to corners), like a smart phone.

The front 16 of the machine is a painted plastic door 18, with a hinge on the left side (when facing the machine from the front). The front door supports: a 15" touchscreen 20, a nozzle 22 that dispenses the beverage, an aesthetic lens 24 for LED lighting mounted on the door behind the lens, a platform 26 for the user to support a beverage container (not shown), and a removable drip tray 28.

The refill station 30 (the portion at the front of the machine where the beverage container is filled or refilled) is either molded into the door or made of plastic attached to the door. In one example, the refill station is recessed in the door and is 40 cm tall, 40 cm wide, and 12 cm deep (from the outermost portion of the front face of the machine to the innermost recess of the refill station) with 4.8 cm radii at each of the edges. The refill station has three sides (top 32, back 34, and bottom 36). The upper end 40 of the LED lens encompasses the beverage dispensing nozzle, the lower end 42 of the lens encompasses the beverage container support area and a thin section 44 of the lens extends vertically between the nozzle and the support area. The beverage-dispensing nozzle is located in the middle (left to right) of the top side of the refill station. Most users place their beverage container on the platform 26 of the refill station before dispensing. The light passing from the LEDs through the LED lens therefore illuminates the column of beverage as its descends from the nozzle to the beverage container providing an attractive visual effect.

Figure 4:
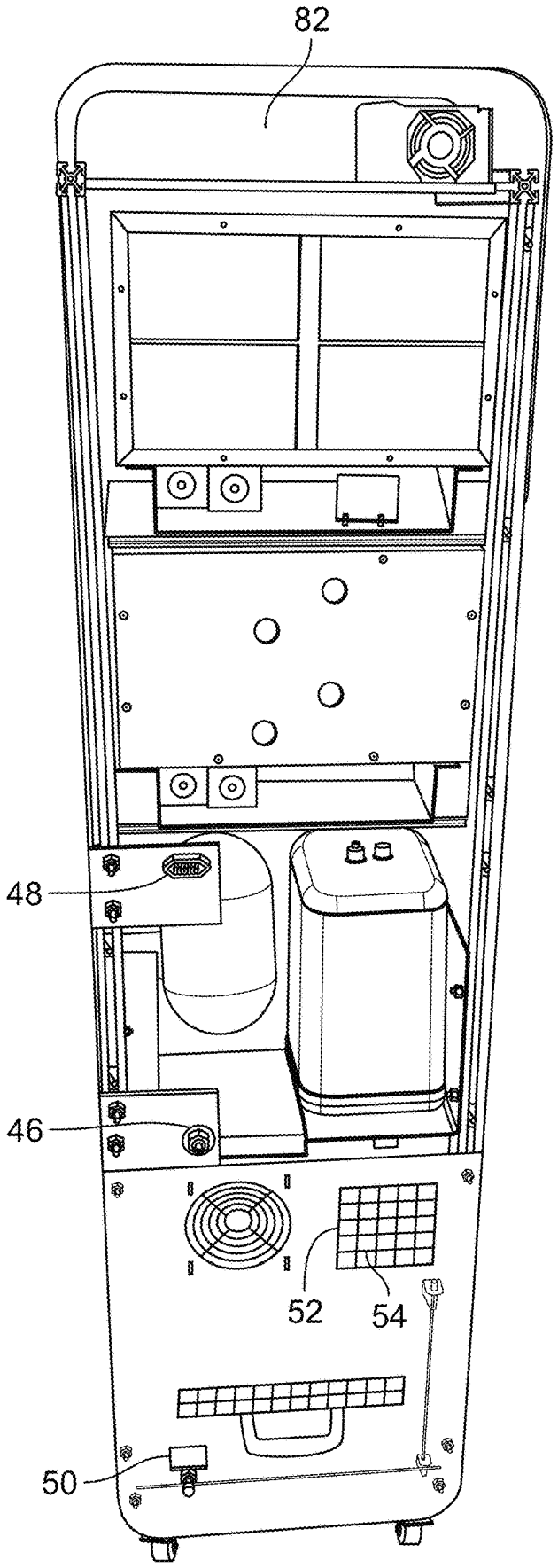
FIG. 4 is a rear view of a beverage dispensing machine.
Figure 5:
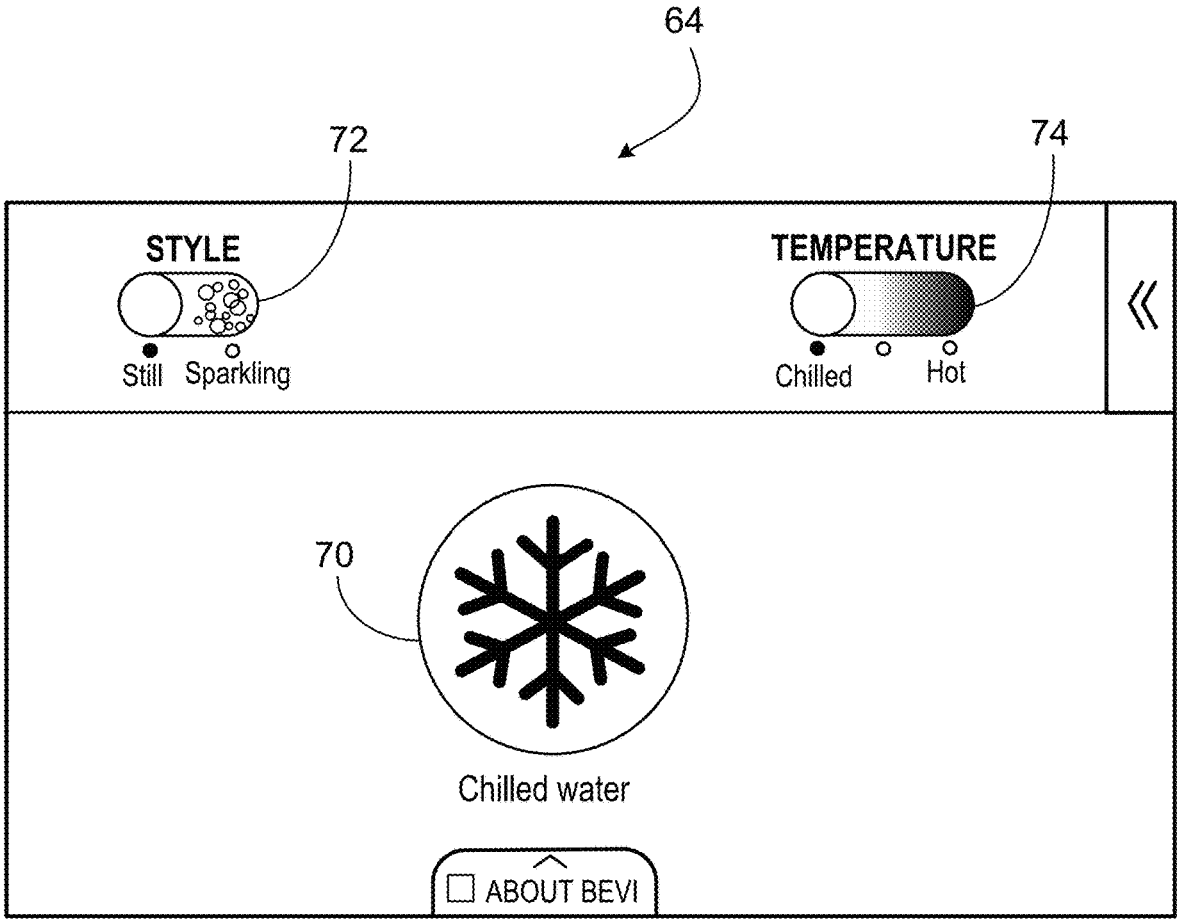
Figure 6:
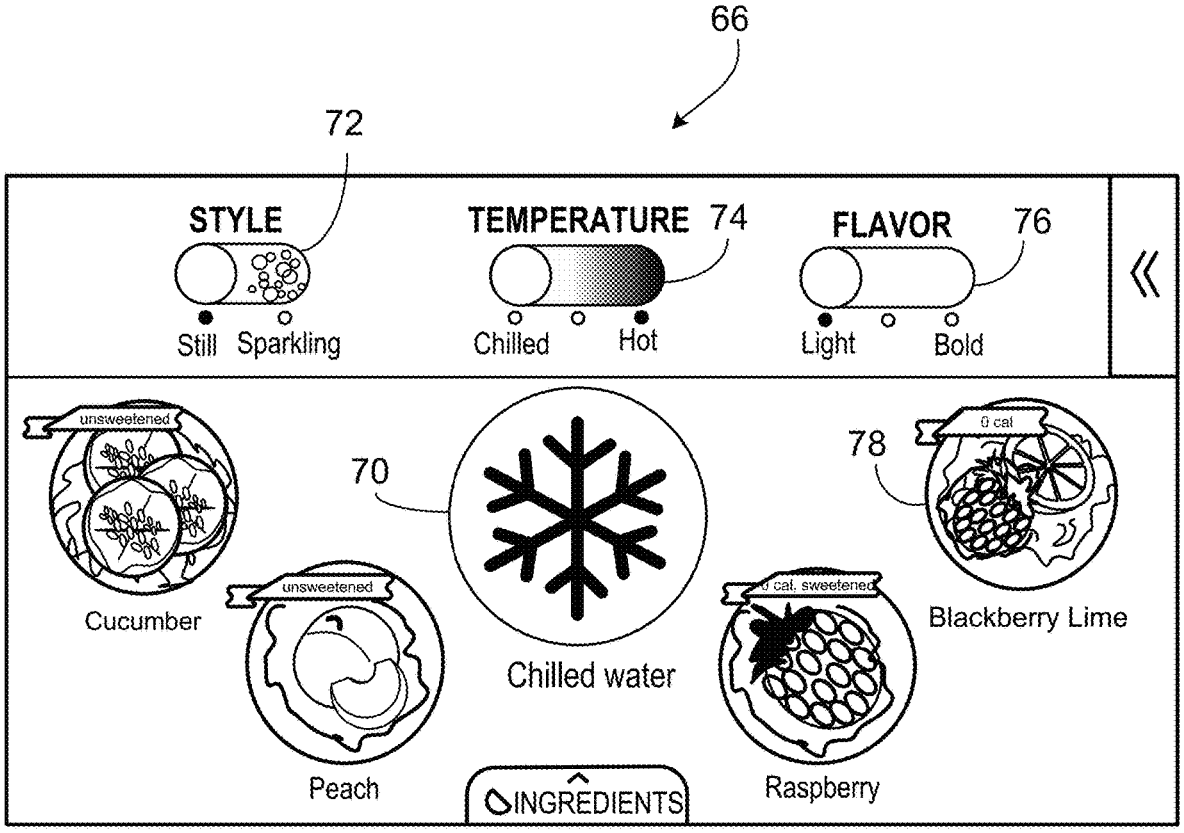
Figure 7:
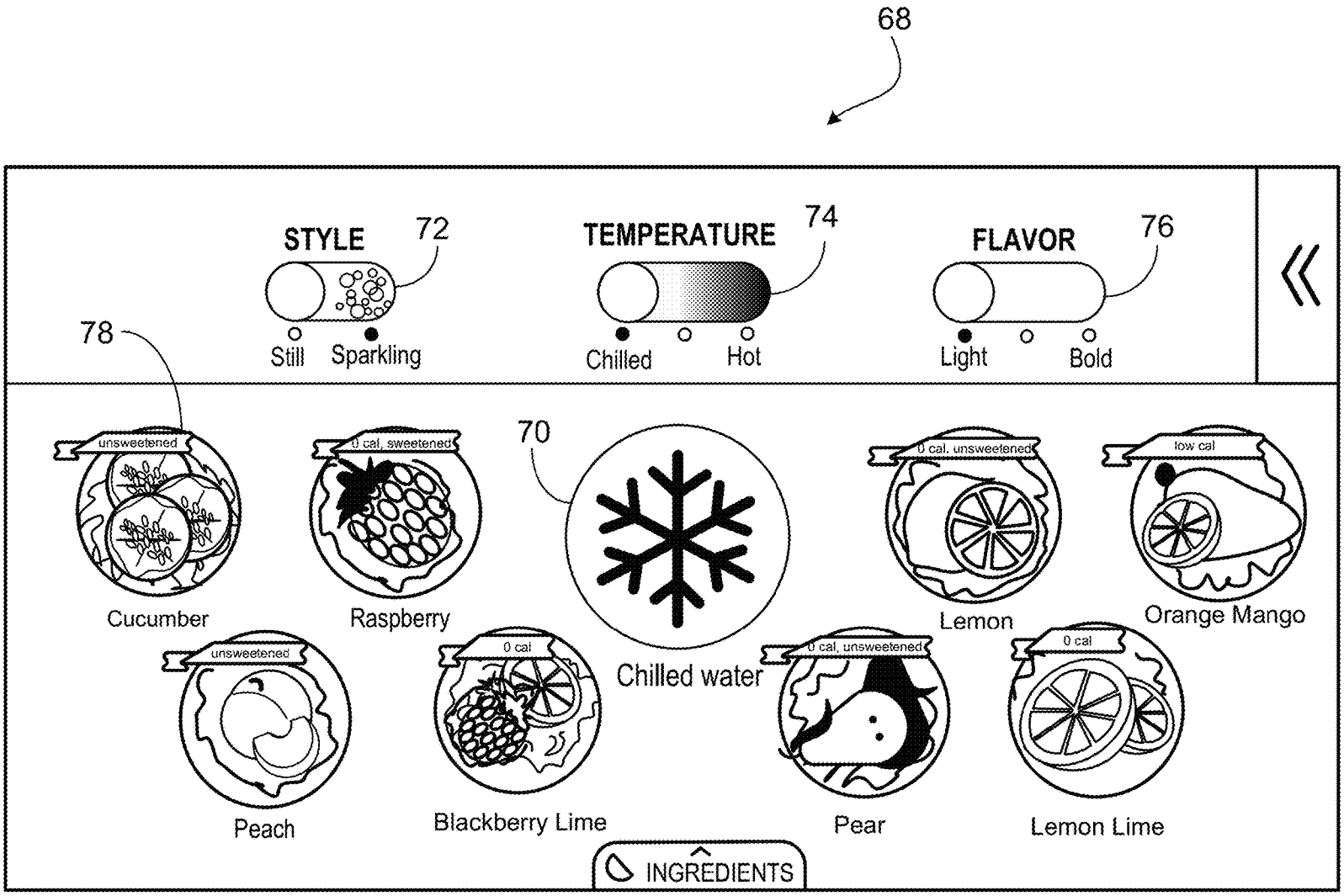

The removable drip tray, which captures spilled water, can be detached from the door to be emptied. Overflow water can be routed to the base of the machine As shown in FIG. 4, on the back left, the machine has a fluid coupler 46 that connects to a tap water line and an electrical connector 48 that connects to a 120 VAC (for example) power line.

A ⅜" OD flexible plastic water line connects from a tap (e.g., under a sink) and goes into the machine through a bulkhead fitting 50 in the back wall.

The back wall of the machine contains an electrical connector for a power line. The line connects the machine to a standard 3-prong electrical outlet on a wall.

The back of the machine also contains vents 52 to allow intake air to enter and to let out hot air that can build up from the heat exchanger inside the machine. A mesh screen 54 covers the vents (from the inside of the machine) to make sure no insects enter the machine. Spacers can be provided on the back of the machine to maintain a gap between a wall and the back of the machine.

Towards the bottom of the back of the machine there is a port 56 to fill an ice bank 58 of a chiller 60 (described later) and a clear visual indicator 62 of the level of water in the ice bank.

A user interface presented through the touch-sensitive display screen 20 (which we sometimes call simply a "touchscreen") of the machine presents touch-invocable user-selectable options for characteristics of the beverage to be dispensed. In some cases the options are presented in the form of icons that present graphical representations or text or both corresponding to the characteristics of beverages to be dispensed. The options are presented on the touchscreen by software running on a processor associated with the touchscreen based on capabilities of components of the machine and on the "model" of machine as characterized in marketing or commercial arrangements with customers. In this way the same basic machine can take the form of different models and provide different beverage dispensing options to end users simply by configuring or reconfiguring the software. In some cases, there could be three different models of the machine: Basic, Classic, and Premium having the respective user interface configurations 64, 66, 68, shown in FIGS. 5, 6, and 7. All three models provide an approximately 2" diameter circular dispensing button 70 (icon) to be touched to dispense a beverage, a toggle slider 72 (icon) to select a style of beverage (e.g., sparkling or still) and a toggle slider 74 (icon) to select a temperature of beverage (e.g., hot or cold). The Classic and Premium models also have a toggle slider 76 (icon) to control the light or bold quality of the beverage flavor. In these examples, the toggle slider for style has two positions as shown and the temperature and flavor toggle sliders have three positions each. In other examples, the numbers of positions of the toggle sliders could be different, and other types of graphical user interface controls could be used in place of the toggle sliders. The Classic and Premium models also have circular flavor buttons 78 for selecting a flavor. In some implementations, the sliders can allow continuously variable selections of beverage characteristics, so that, for example, a user could choose any degree of carbonation or any temperature or any style within a range.

In all models, the dispense button allows the user to dispense a beverage (e.g., a type of water), and the toggle sliders allow the user to change the type of water to be dispensed. The appearance of the dispense button in the center of the screen changes depending on a state determined by the sliders. There are a total of five possible states, which determine how the machine will behave when the dispense button is touched and released. The dispense button displays a picture and has text below it indicating the state, e.g., the type of water to be dispensed if the button is pressed (for example, chilled water, unchilled water, hot water, more sparkling, and less sparkling). When the dispense button is touched continuously for more than ⅓ of a second, a beverage starts dispensing. When the user releases their finger, the beverage promptly stops dispensing. While the dispense button is being touched, the beverage is ejected from the nozzle and falls in a stream into the beverage container on the platform. Whenever the dispense button is not being touched, the user can change the positions of the toggle sliders and can choose a flavor to govern the characteristics of the beverage that will be dispensed the next time the dispense button is held for more than ⅓ of a second.

Because of the design and operation of components of the machine, users can switch between hot, cold, and sparkling water beverages quickly without affecting each subsequent beverage with components of the previous beverage. For example, as soon as a sparkling beverage has been dispensed, a user can invoke icons on the user interface to select and dispense a hot beverage without any sparkling water "contaminating" the hot beverage. A user can dispense any level of carbonation in the water for a beverage, from still to fully saturated with carbon dioxide. The machine provides this capability by being able to dispense still water and sparkling water at the nozzle simultaneously, in any ratio. Also a user can cause a beverage to have a mix of flavors from different consumable supplies by touching two or more icons simultaneously, for example, lemon and lime icons to dispense a lemon-lime flavored beverage. The machine is able to offer this feature because of its ability to dispense two or more different flavors from different supplies simultaneously at the nozzle.

The components located inside the machine are divided into two main subsystems: an electronics subsystem and a fluid subsystem the components of which are found throughout the machine.

Figure 8:
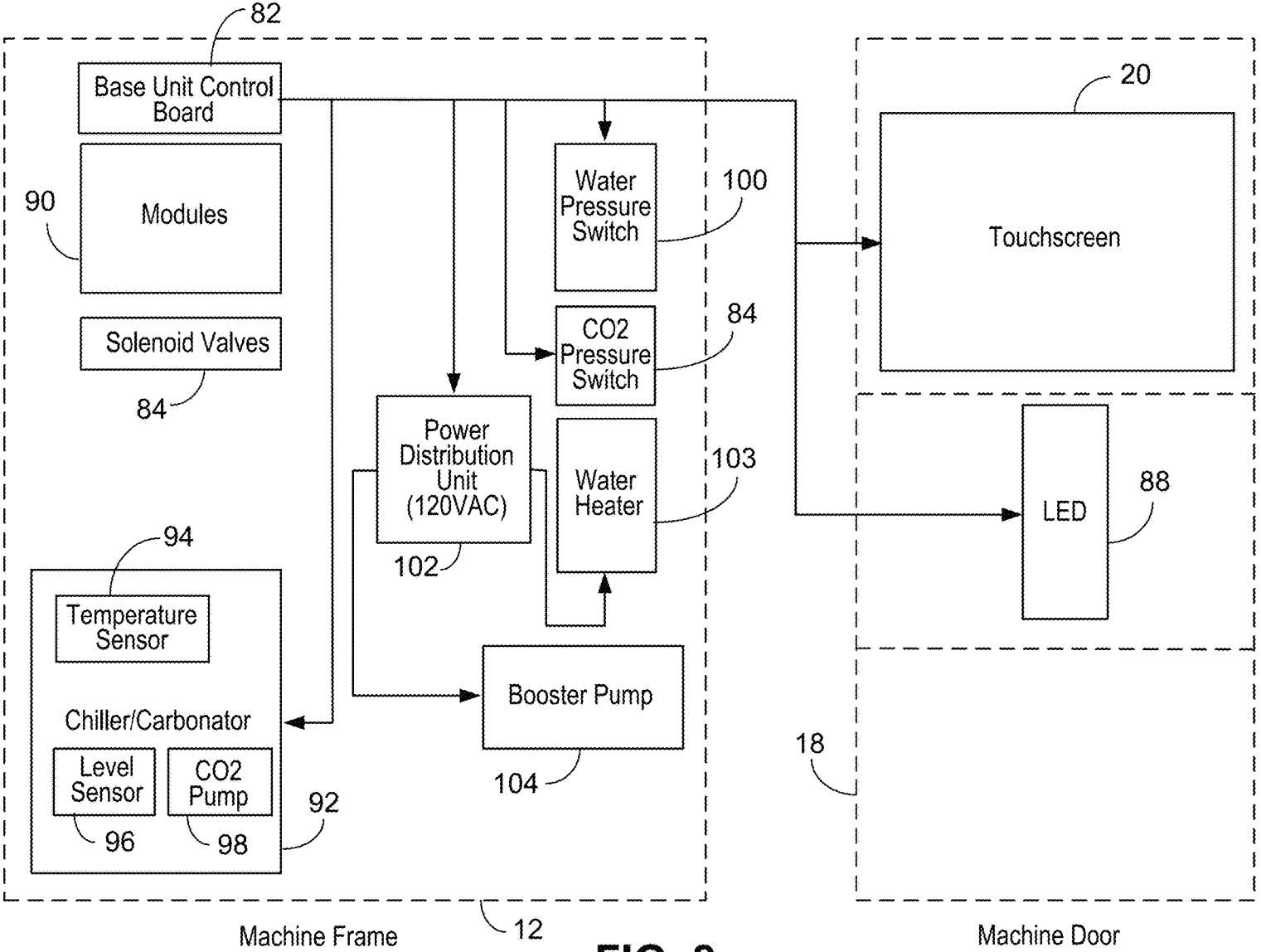

As shown in FIG. 8, the main electronics components are the touchscreen 20 and a base unit control board 82 that includes a processor and a memory that stores software instructions executable by the processor to implement the features of the machine. The touchscreen is mounted to the front face of the door and the base unit control board sits at the top inside the machine. In general, the user interacts with the touchscreen which communicates with the base unit control board. The base unit control board also reads data from a variety of sensors, including sensors on components of the fluid system to determine, for example, the status of the machine (e.g., the CO2 pressure switch 84) and controls actuator components of the fluid system (e.g., solenoid valves 86) based on the sensed information. The base unit control board also drives the LED 88 on the machine door 18.

The components of the machine also include one, two, or more modules 90, a chiller/carbonator 92 (which we sometimes call simply a "chiller") including a temperature sensor 94, a level sensor 96, a CO2 pump 98, a water pressure switch 100, a power distribution unit 102, a water heater 103, and a booster pump 104. The modules 90 also include sensors, including sensors indicating the presence of individual consumable supply containers (which we sometimes call "modules", for example.

Figure 9:
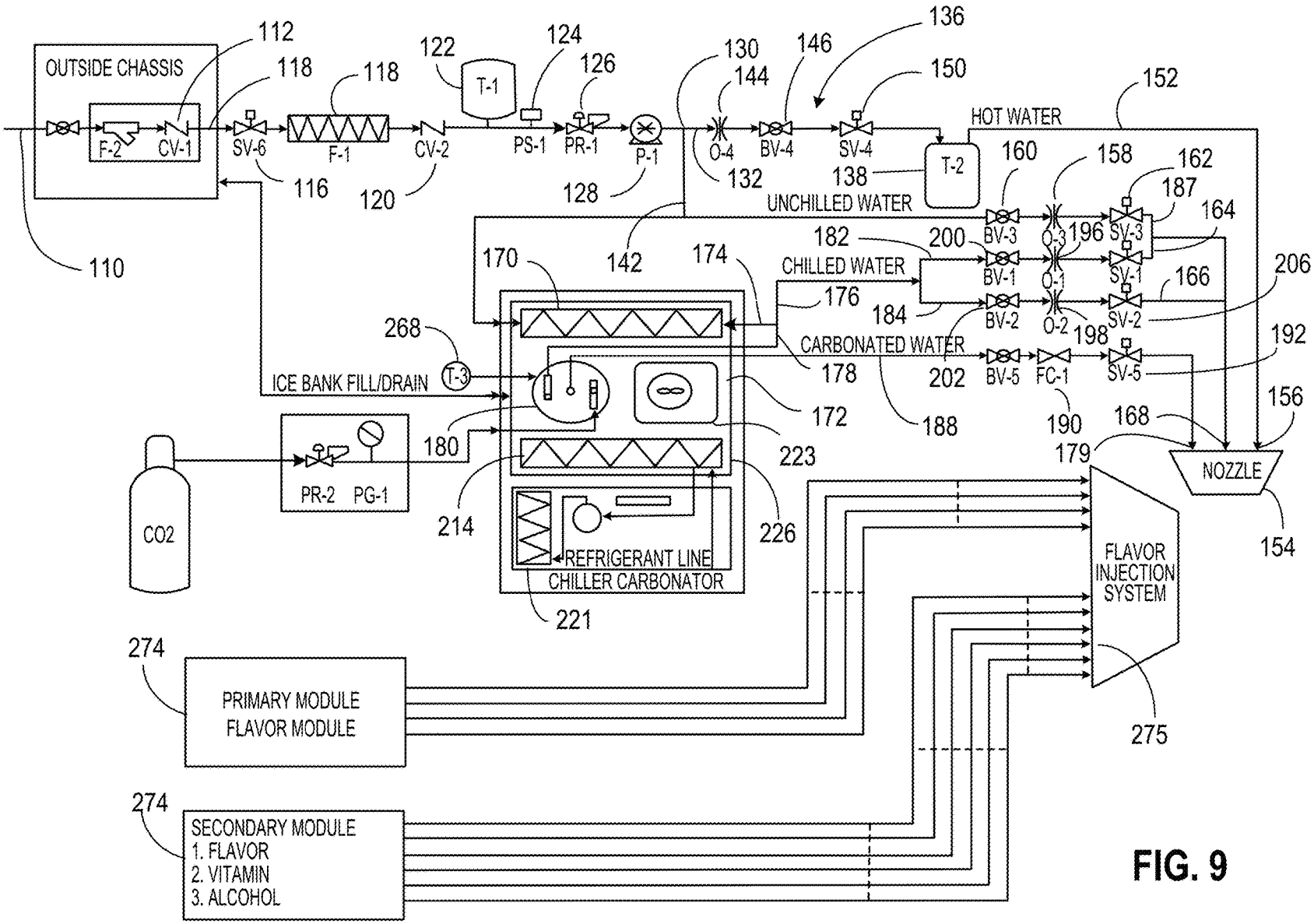

As shown in FIG. 9, the source tap water enters the machine through a ⅜" (or in some case a ¼") outer-diameter water line 110.

The water line feeds into a backflow preventer 112, which prevents carbonated water from going backwards into the tap water system. The water exits the backflow preventer and passes into the frame through a bulkhead fitting. A ⅜" outer-diameter tube exits the bulkhead fitting and connects to a normally closed solenoid valve 116 that prevents additional water from entering the fluid subsystem when a beverage is not being dispensed, protecting against catastrophic leaks.

The water flows from the solenoid to a water filter 118. After the water filter the water flows through a check valve 120 to a bladder tank 122. The filter removes chlorine and particulates larger than a size within a range of 0.2 microns and 5 microns, for example, 0.5 microns. The bladder tank ensures a consistent supply of water downstream when the water from the filter in a low flow or a low pressure condition.

A pressure sensor (transducer) 124, located downstream of the bladder tank in the flow path, reports the water pressure in the bladder tank and attached water line. The signals from the pressure transducer are used to determine when the water filter needs to be changed, and to detect leaks as explained below.

The water then enters a pressure regulator 126 that reduces the pressure of the water to 60 psi. Water then flows into a water pump 128.

From the water pump, water flows into a tee fitting 130 which splits off a ¼" OD polyethylene water line. The ¼" water line feeds into a 1-to-2 fitting 134, which splits into two paths, one path 136 to supply a hot water tank 138 and the other path to supply an un-chilled water line 142.

On the way to the hot water tank the water flows through an orifice 144 which reduces the flow rate to 2 liters per minute. Water then flows through a ball valve 146. The ball valve is used to turn off this plumbing flow path 136 when servicing the machine. After the ball valve a solenoid valve 150 starts and stops the flow of water in this plumbing flow path. When the solenoid valve opens, water flows into the hot water tank. Water leaves the hot water tank through a 5/16" OD silicone tube 152. Silicone is used because the water temperature is too high for the polyethylene tubing used elsewhere in the machine. From the hot water tank the water flows directly to the nozzle 154 and enters the nozzle through a port 156 reserved for hot water.

In the un-chilled plumbing path water flows through a ball valve 160 and then through an orifice 158 which reduces the flow rate to 2 liters per minute. The ball valve is used to turn off this plumbing path when servicing the machine. After the ball valve and orifice, a solenoid valve 162 starts and stops the flow of water in this plumbing branch. When the solenoid valve opens, water flows toward the nozzle along a path in which it joins the flow path of the chilled water 164 and a reduced flow chilled water path 166. All three paths enter the nozzle through the same port 168. Therefore the water delivered at the port 168 can be a controlled mix of un-chilled water, chilled water at one flow rate and chilled water at a reduced flow rate. This permits fine control of the temperature of the chilled water at the nozzle port.

From the water pump the water that is not split off for the hot water line and un-chilled water line flows through a ⅜" OD polyethylene tube to a stainless steel heat exchanger coil 170 which is immersed in a chiller ice bath 172. Water exits the heat exchanger coil through a ⅜" OD polyethylene tube 174. The ⅜" OD tube is split into two ¼" OD polyethylene water lines 176, 178. One line supplies a carbonator 180, the other line supplies the chilled water line 182 and the reduced flow chilled water line 184.

In the carbonated water line, water flows into the carbonation tank 180. Carbonated water exits the carbonation tank through a ¼" OD polyethylene water line 188. The carbonated water then passes through a flow compensator 190 and solenoid valve 192 and flows to the nozzle. The flow compensator is designed to reduce the water pressure and flow rate of the carbonated water in a way that does not create turbulence. The solenoid valve starts and stops the flow.

In the chilled water line the water flows into a 1-to-2 fitting 194 that splits it into a path 182 that joins the un-chilled water line 187 and the reduced flow chilled water line 184.

In both chilled water lines, the water flows through an orifice 196, 198 which reduces the flow rate. Water then flows through a ball valve 200, 202. The ball valve is used to turn off the corresponding plumbing path when servicing the machine. After the ball valve a solenoid valve 204, 206 starts and stops the flow of water in the corresponding plumbing branch. One difference between the two paths is that the orifice in the reduced flow water line is a different size. It reduces the flow rate to 0.2 liters per minute, rather than 2 liters per minute in the full flow chilled water line.

The solenoid valve for the reduced flow water line can be activated at the same time as the solenoid valve for the carbonated water line, to produce a reduced carbonation beverage. The chilled still water simply dilutes the carbonated water. The dispensing of a reduced carbonation beverage is controlled from the carbonation toggle slider of the user interface. Any level of carbonation within a range can be achieved by control of the two solenoid valves.

As shown in FIGS. 10, 11, and 12, the chiller stores cooling capacity in the form of a block of ice 210 and chilled water in an ice bath 212. Refrigeration coolant flows through refrigerant evaporation coils 214 immersed in the chilled water and to which the ice block is attached. Drinking water for beverages flows through heat exchange coils 170 also immersed in the chilled water. This design allows for cooling of up to 100 liters of water continuously by a chiller with a total volume of less than 1.4 cubic feet. The relative positions of the refrigeration coils and the drinking water coils allows a large amount of ice to develop in the ice bath without the possibility of accidentally freezing the water inside the drinking water coil because the ice that develops on the refrigerant evaporation coils does not touch the drinking water coils.

The chiller also houses the tank 180 for carbonating water, a carbonation pump 220 to drive water into the tank, a refrigerant compressor 221, a control printed circuit board 222 for the refrigerant compressor, an ice bath stirrer 223, a refrigerant condenser coil and fan 224, an insulated ice bank tank 226, a drinking water heat exchange coil 170, a refrigerant evaporator coil 214, a drinking water sub plate 232, a carbonation tank 180, a refrigeration sub plate 236, and coil spacers 238.

A summary of the flow of drinking water with respect to the chiller includes the following sequence: Water enters the heat exchange coil at point 402. Water exits the heat exchange coil at point 404. The water line tees with one line 178 going to the carbonation pump and one line going to the nozzle port 179 for chilled still water. Water enters the carbonation pump at point 408. Water exits the carbonation pump at point 410. Water enters the carbonation tank at point 412. CO2 enters the carbonation tank at point 414. Carbonated water exits the carbonation tank at point 416.

The chiller can effectively chill water passing through the drinking water heat exchanger coil at a relatively high flow rate even though the chiller occupies a relatively small volume. In one example, the ice bank tank is 8.6" wide, 12.7" long, and 10.5" tall and the chiller and is designed to freeze a relatively large proportion (about ⅓ of the total volume of water in the ice bank tank) into a block of ice.

Among the features of the design of the chiller are the following: A drinking water sub-plate 232 supports the drinking water heat exchange coil, the carbonation tank, and the carbonator pump. A refrigeration sub-plate 236 supports all refrigeration components and the ice bath stirrer. Four coils spacers 238 keep the heat exchanger coils uniformly spaced, which facilitates good circulation of ice bath water. All four coil spacers are designed to be the same part. Each of the coils 251, 253 (which we sometimes also call simply tubes) is designed to be assembled from two identical sub-coils 252, 254, by joining respective free ends 255, 257 that are oriented 180-degrees opposite to each other. The drinking water sub-coils are sized to allow the carbonation tank to be located concentrically within the interior space of one of the sub-coils. The refrigerant in the refrigerant sub-coils causes a solid block of ice 210 to be formed on the sub-coils and maintained on the refrigeration side of the ice bath. A large cooling capacity is stored in the ice block. The refrigerant coil ejects heat out the rear wall of the machine.

The ice bank tank is a rectangular, vacuum-formed plastic tub 261. The top edge of the tub has a 0.45" horizontal flange 258 around the entire top edge to 63. Closed cell foam insulation 260 is applied in a molding process to the outside of the plastic tub. The thickness of the foam is 0.5" and secured than that dimension on the bottom. The foam insulation covers all five sides of the plastic tub but not the top.

The ice bank tank holds approximately 5 gallons of cooling water, some of it in the form of the ice block. Two heat exchangers are immersed in the cooling water. One heat exchanger 214 is for refrigerant-to-cooling water heat transfer. The other heat exchanger 170 is for cooling-water-to-drinking water heat transfer.

The lid of the ice bank is split into two sheet metal parts 232, 236 which act as mounting points for two subassemblies. One subassembly includes the drinking water plumbing. The other subassembly includes all the refrigeration plumbing.

The refrigeration system is made up of a refrigerant compressor 221, a refrigerant-to-air heat exchanger 224, a refrigerant-to-water heat exchanger 214, a printed circuit board 222 that controls the compressor, and a tank stirrer/recirculation pump 223.

The compressor 221 is a scroll type compressor, with a 450-watt cooling capacity. The compressor uses a R-134A refrigerant, is powered by 48 VDC, and draws approximately 220 watts under normal operating conditions. The circuit board 222 supplies power to the compressor and controls its speed.

The refrigeration assembly includes a copper tube, aluminum-fin-type heat exchanger 252, has an integral fan, powered by 48 VDC, and an integrated filter dryer. A capillary tube which maintains a pressure differential between the high-pressure and low-pressure sides of the refrigerant system is also part of the heat exchanger 222.

The immersed refrigerant heat exchanger is constructed of two identical sub-coils of 5/16" outside diameter copper tubing. Each sub-coil has an outside diameter of 4.0125". The tubing is wound clockwise 21.75 revolutions at a pitch of 0.414 inches per revolution. One end of the sub-coil terminates in a 1"-straight length of tubing 255 which is tangential to the coil circumference. The other end of the tubing sub-coil terminates in a 90 degree bend away from the coil, then a straight 3" length aligned parallel to the axis of the coil. When the coil is immersed in the ice bank cooling water, the end with the 1" straight length is below the surface of the water. As shown in FIG. 13, to form the complete heat exchanger two of the tubing sub-coils are oriented 180 degrees opposed to each other, such that the 1"-straight lengths of the two sub-coils are collinear. The 1"-straight lengths are joined by brazing with a copper tube union to form the complete heat exchanger.

An electric motor 258 has a shaft that extends down into the cooling water in the tank. A propeller (not shown) at the submersed end of the shaft agitates the cooling water. The agitation of the cooling water is an important part of achieving the heat transfer from the cooling water to the drinking water. The component 223 also has a recirculation pump which recirculates cooling water through a cooling jacket on the beverage lines that go to the nozzle. The cooling jacket on the beverage lines keeps the beverage cold while the machine is idle. Without the cooling jacket, the first beverage dispensing after the machine has been idle will include the warm beverage that has been sitting in the beverage lines which would degrade the quality of the drink.

In operation, water enters the chiller through a 3/8" outside diameter polyethylene tube. The water flows through the tube to the inlet of a water pump. The inlet fitting on the water pump is a 3/8" NPTM×3/8" push-to-connect elbow made of polypropylene. The water pump is a 3 chamber diaphragm pump, capable of moving 1.5 GPM at 150 PSI. The pump is powered by 120V AC 60 Hz. The water pump is attached to a sheet metal bracket, which is attached to the drinking water tank.

Drinking water flows out of the water pump through a 3/8" NPTM×3/8" push-to-connect elbow made of polypropylene. Drinking water flows through a 3/8" outside diameter polyethylene tube to the inlet of the drinking water heat exchanger. Water enters the drinking water heat exchanger through a 3/8" push to connect×1/4" push to connect for stainless steel elbow fitting.

Water flows through the drinking water heat exchanger and exits through a 3/8" push to connect×1/4" push to connect stainless steel elbow fitting made of acetal plastic. Water flows through a 3/8" outside diameter polyethylene tube to a fitting with a 3/8" push to connect inlet and three 1/4" push to connect outlets. As previously mentioned, one outlet supplies chilled water to the nozzle. One outlet supplies chilled water to be used for dilution of carbonated water for reduced carbonation beverages. One outlet supplies water to the carbonation tank through a 1/4" outside diameter polyethylene tube. Water enters the carbonation tank through a 1/4" push to connect×5/16" push to connect elbow fitting with a built in check valve, that prevents liquid or gas from exiting the tank through this fitting.

The carbonation tank is constructed of stainless steel to form a cylinder 3.5" in diameter×9" long. There are three 5/16" outside diameter tube stubs 412, 414, 416 welded to the top surface of the tank. Two of the tube stubs act as inlets, one for water and one for CO2. The third tube stub acts as an outlet. The outlet tube stub is oriented co-linearly with the central axis of the tank and extends 3/4 of the way to the bottom of the tank. The water inlet tube stub does not extend below the wall of the tank on the inside. The water inlet tube has a 0.047" orifice. The CO2 gas inlet tube also does not extend below the surface of the tank on the inside of the tank. There is no restrictive orifice in the CO2 gas inlet. The carbonation tank has a threaded drain plug 266 on the bottom face of the tank, which seals with an o-ring.

In operation, CO2 gas enters the carbonation tank through a 1/4" push-to-connect×5/16" push-to-connect elbow fitting. The fitting has a built in check valve to prevent liquid or gas from exiting the tank through this fitting. The fitting also has a built in pressure relief valve that opens at 140 PSI. The fitting also has a built in probe which acts as a level switch. When the tank is full of water it holds approximately 1 liter.

Water and CO2 gas mix inside the tank causing the water to become carbonated. Carbonated water exits the carbonation tank through a 5/16" push-to-connect×1/4" push-to-connect elbow fitting made of polypropylene. The carbonated water leaves the chiller through a ¼" outside diameter polyethylene tube and continues to other components of the beverage dispensing system.

In operation, the carbonation pump is turned on (and off) to maintain a predetermined water level inside the carbonation tank. A level switch is located inside the carbonation tank and is integrated into the CO2 gas inlet fitting on the carbonation tank. The level switch operates on the basis of electrical continuity between a metal probe suspended inside the tank and the metal walls of the tank. When the water level rises inside the tank to a height at which the level switch is immersed in water, the water closes the circuit, triggering the level switch. When the water level in the carbonation tank is at a height at which the level switch circuit is open, the carbonation pump is supplied with power. When the water level inside the carbonation tank is at a height such that the level switch circuit is closed, the carbonation pump is turned off.

The refrigeration sub-system is controlled by a thermostat. The temperature sensor 268 for the thermostat is located in the cooling water in the ice in the chiller. The temperature sensor is located approximately 1.5 inches below the surface of the water inside the second tubing sub-coil of the drinking water heat exchanger (the second sub-coil as determined by the flow direction of refrigerant). The temperature sensor also is located approximately 0.5 inches from the refrigerant heat exchanger coil. The thermostat set point is −0.5 degrees Celsius, with a dead band of 1.0 degrees Celsius.

Among the features of the fluid system of the beverage dispenser are the following. the water pump 128 is used to push water through the flow path to maintain a constant flow rate, regardless of water pressure or water flow available from the water tap at the wall. Maintaining a constant flow rate helps to assure the quality and consistency of the beverages dispensed of the nozzle.

The bladder tank 122 serves as a buffer for usage of water by the beverage dispenser so that low pressure at the water tap does not interfere with the amount of water being dispensed at the nozzle. The bladder tank also allows for varying flow through the water filter without interfering with rate at which water is dispensed at the nozzle. This accommodates filters that are at different stages of useful life. As filters are used, they become clogged and therefore yield a reduced flow rate through the filter.

It is useful to be able to determine the remaining life in the water filter. Data from the pressure sensor on the bladder tank can be used for this purpose. The data indicates how long it takes to restore full pressure on the downstream side of the filter after a beverages dispensed and at a location between the filter and bladder tank. The amount of time it takes to restore full pressure is an indication of the clog state of the filter and allows a determination of the remaining filter life. The longer the time to restore full pressure, the less filter life is remaining.

The data from the pressure sensor on the bladder tank can also be used to detect leaks by monitoring how long it takes for pressure in bladder tank to return to full pressure after a beverage is dispensed.

The recirculation pump for carbonation of the water takes carbonated water from the carbonation tank and pushes it through the carbonation circuit additional times. This recirculation results in higher levels of dissolved carbon dioxide which produces more intense bubbling in the dispensed beverages. In some cases, the recirculation feature can achieve essentially water that is fully saturated with carbon dioxide.

Figure 15:
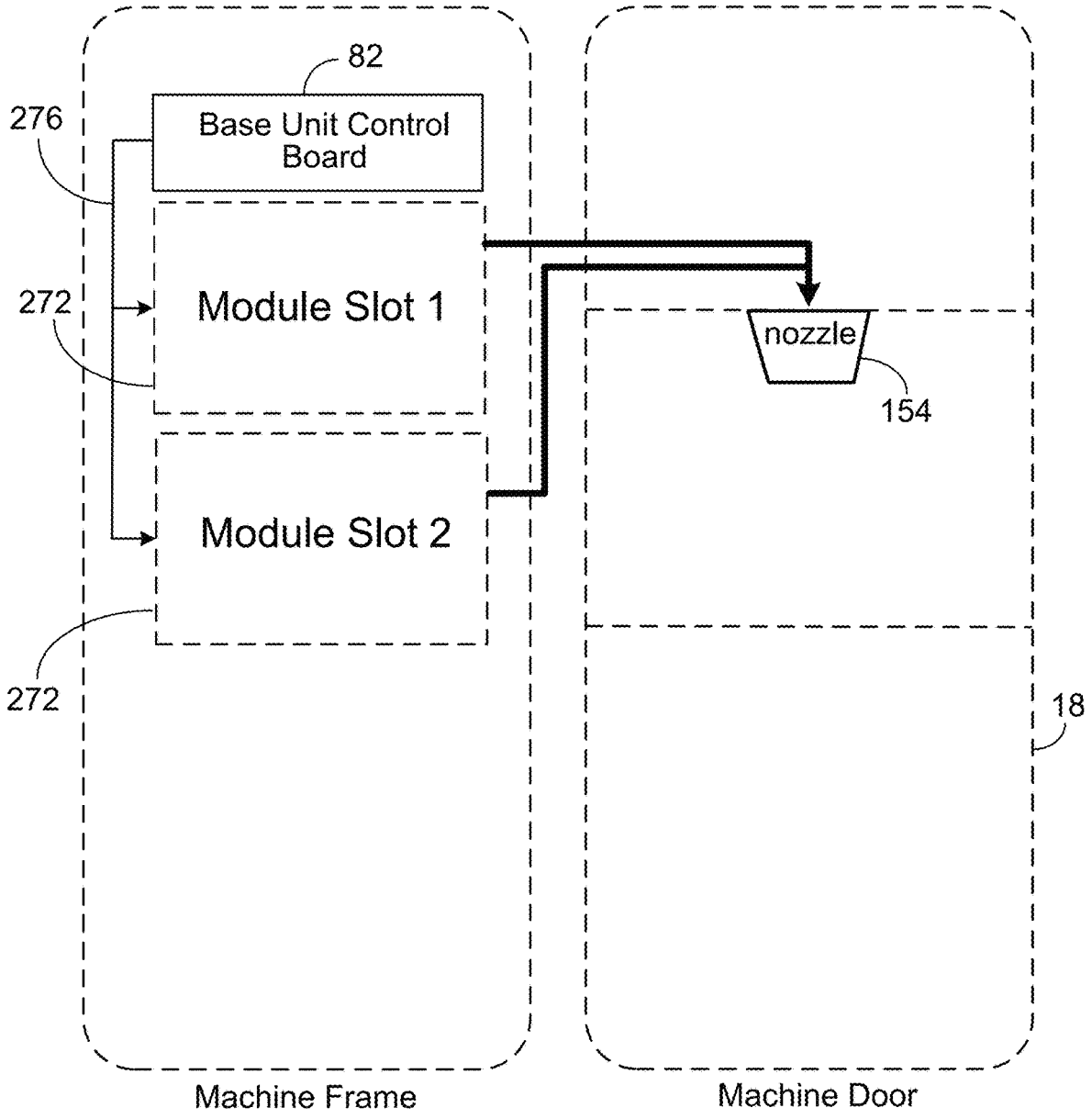

As shown in FIG. 15, the machine has two slots 272 for modules, which enable a wide range of beverage options to be offered in addition to chilled, unchilled, hot, more sparkling and less sparkling water. In some implementations, each of the module slots can hold up to six different modules to provide the additional options. We sometimes refer to the slots as modules and to the modules as containers of consumable supplies or consumable containers. The additional beverage options could include flavors, vitamins, alcohol, and other additives. We use the term "additives" broadly to include, for example, any material to be included as part of a beverage to be dispensed at the point of use. We sometimes use the term "consumables" interchangeably with the word "additives" Each module slot has two connections to the machine, one electrical and one fluid. The electrical connection 276 is a USB electrical connection from a module control board 282 in each of the slots to the base unit control board 82, which allows the machine to communicate with the module slot by sending commands (to control any actuators located inside the module slot) and retrieving information (to gather data on module status and sensor readings, for example).

The fluid connection 277 from each of the module slots 272 is a six-line ⅛" OD tubing fluid connection to the nozzle additive ports 275 (FIG. 9, which enables flow of potentially six different additives from the consumable containers (concentrated or pre-mixed, for example) held in various positions in the module slot to dispense from the machine nozzle at the point-of-use. Each of the slots (modules) also includes a peristaltic pump for each of the modules (consumable containers) in the slot, to pump an additive (consumable) from the corresponding module (consumable container) to the corresponding additive port associated with the nozzle. Each of the slots also includes an RFID reader 285 for each of the modules held in the slot. The RFID reader can read RFID tags 291 on the corresponding modules and in that way provide information to the base unit control board about the characteristics of the additive, the volume of the module, age, and other information. Instead of RFID tags, each of the consumable containers could bear a barcode, a QR code, or a variety of other machine-readable indicators.

Typically each module (slot) has four to six positions (although in some cases as few as one position) for additives. The additives may be in the form of concentrates to be mixed with water at a 1:35 ratio, for example. Normally, an additive will be a fluid. A wide variety of other ratios could be used depending on the characteristics of the additive.

As shown in FIG. 17, each of these slot positions is configured to receive a consumable container 271 of a particular additive. In some implementations, the consumable containers for each module conform to the beverage dispensing industry standard "Bag-in-Box" format. In that format, a fluid beverage concentrate is stored in a bladder or bag 280 with an adapter valve 282 and packaged inside a cardboard box 284.

Figure 16:
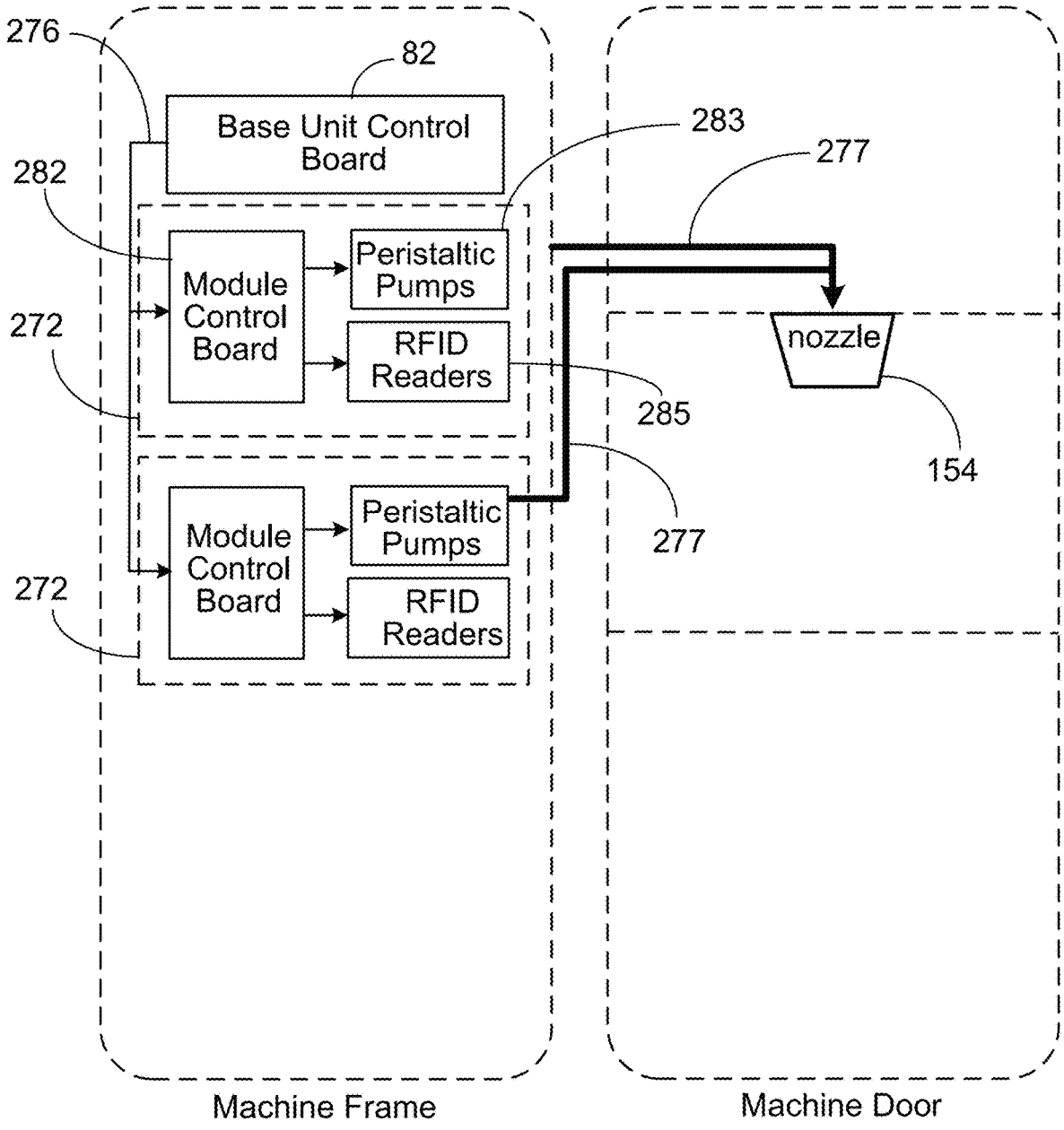

As shown in FIG. 16, each module includes a control board 282, a peristaltic pump 283 for each of the slots, an RFID reader 285 for each of the slots, and a level sensor 288 for each of the slots. The module control board controls each of the peristaltic pumps with a pulse-width-modulated 24 VDC signal to control the pump flow rate output from the corresponding consumable container. The inlets of the peristaltic pumps are connected to the adapters of the consumable containers and the outputs of the peristaltic pumps are connected directly to ports at the nozzle. The RFID readers in the module are used to sense information stored in RFID stickers attached to consumable containers that are physically swapped inside each of the slot positions as the contents of each consumable container are depleted.

As shown in FIG. 15, in some implementations, each of the slots has four positions for consumable containers. The consumable containers are removable and have an internal level sensor to detect the amount of fluid stored within it. In some cases, a user can remove a cap on the top of the container and fill it with a beverage additive.

The modularity (slots and consumable containers in positions in the slots) of the machine enable technicians to replace empty consumable containers with similar replacements or to substitute new types of consumable containers as they are developed. These new modules will enable the machine to dispense different types of beverages based on the type of consumable container.

Each machine can be configured with 0, 1, or a combination of 2 (same or different) modules (slots). Each module can be dedicated to a particular class of beverage so that all of the consumable containers mounted in that module will belong to that class. Classes of beverages can include flavored drinks, functional drinks (vitamins, supplements, caffeine, for example), hot drinks space (coffee, tea, for example), or alcoholic drinks.

The identification information included in the RFID or other coded indicators on the consumable containers is read by an RFID or other reader in the coded information is sent to a database at a server through an Internet connection. At the server, the shelf life of the consumable supply in the container can be automatically monitored. The monitoring can be based on the coded information, the time when the consumable container was first installed in a slot of the machine, the time when the consumable container was first put into use and a consumable was drawn from the consumable container for a beverage to be dispensed, and information about the shelf life of the consumable supply within the consumable container either while the consumable container remained on opened or beginning when it was opened.

At the server, a dashboard (discussed below) can display information about consumable containers being tracked for each of the large number of machines at a variety of locations.

Also at the central server, the information in the database can be analyzed by a processor for a variety of purposes. Trends of expired consumable containers of different types, in different locations, and at different times can be tracked for various purposes. By analyzing the expiration dates of consumables compared to the times when the consumables in consumable containers are depleted, information about the economic value or viability of consumables with respect to the type of consumable (e.g., a flavor), the geographic location at which the consumables were being used, and the times of use can be inferred. For example, when a type of consumable at a particular location during a particular time of year frequently expires before it is depleted, the analysis can determine that this type of consumable is more expensive or less profitable than other consumables might be.

The central server in the database can use the information provided by the machines about the consumable containers to maintain a comprehensive inventory of all consumable containers in all machines being managed.

In some implementations, the usage of consumables can be tracked and analyzed at the central server using the database information to predict usage per machine or per customer or per region or per other arbitrary grouping of machines. Information about usage of consumable supplies can be used at the central server to proactively send identify the upcoming need for replacing consumable containers, to order additional consumable containers for inventory purposes, and to send alarms or alerts to a variety of parties who may act on the information, such as customer businesses at which the machines are located, to service people, or to service partner companies, for example.

Information about usage of consumable supplies can also be used to determine and predict seasonal trends in the use of particular types of consumable supplies in particular geographic places. Information about such seasonal trends can be used in marketing relevant types of consumable supplies. In some cases, information about usage of consumable supplies can be used as a basis for discontinuing types of supplies that are unpopular.

When the central server or the machine itself determines that one or more consumable supplies in slots in the machine have expired, the machine can be instructed to (or can itself) disable the dispensing of beverages based on those consumable supplies.

In some cases, one or more icons on the user interface of a machine can be changed when a consumable supply has become depleted or expired to indicate that the characteristic represented by the consumable supply (such as a flavor) is no longer available for beverages to be dispensed and will be replaced.

In some implementations, the machine can (under instruction from the central server) or on its own initiative alter the display characteristics of one or more icons so that options related to depleted or expired consumables are removed from the menu of options. In some cases, then the user interface display screen would show fewer icons representing consumable supplies than normally available.

As shown in FIGS. 18, 19, and 20, in some implementations, the nozzle assembly includes the following components: a flow compensator housing 290, a separate nozzle body 292 coaxial with the flow compensator housing, concentrate (or other additive or consumable supply) tubes 294, an additives ring 296, and a flow compensator cone 298.

In operation, carbonated water (if used in the beverage being dispensed) enters the nozzle assembly through flow path 300. The carbonated water enters the flow compensator housing, flows around and through the flow compensator cone, and passes through diffusion geometry 302 in the middle of the nozzle body. The purpose of the diffusion geometry is to stabilize the flow of sparkling water that is being dispensed. Without the diffusion geometry the sparkling dispense can be messy. The carbonated water exits the nozzle through exit path 304 and descends to the beverage container. The flow compensator cone is held within the nozzle body, which reduces the number of parts and improves the functioning of the flow compensator cone. The main function of the flow compensator is to maintain adequate back pressure in the carbonated water line. Incorporating the flow compensator into the nozzle keeps the entire beverage flow path at high pressure until the beverage leaves the nozzle. This prevents loss of carbonation while the beverage is flowing through the internal plumbing of the machine.

If used in the beverage being dispensed, hot water enters the nozzle body through flow path 306. The hot water flows into an annular region 308, preventing the hot water from entering the entry path area 310 of the carbonated, chilled, or unchilled water. The hot water exits the nozzle through exit path 304. The nozzle design prevents hot water from contacting components in the other water lines which may not be rated for high temperatures.

Chilled, low flow chilled, and unchilled water enter the nozzle through flow path 314 into the entry path area 310.

Because the three entry locations for hot water, chilled, low flow chilled, and chilled water, and carbonated water are distinct, when the dispensing of a beverage that uses one of them ends and the dispensing of another beverage that uses a different one of the begins (even if the change occurs quickly), the chances of one of the types of water entering the nozzle stream when it is not to be part of the beverage being dispensed, is small. In addition, because all beverages are dispensed from a single nozzle outlet (i.e., there are not multiple outlets for still, sparkling, and hot water), it is simpler to provide various additives to different types of water.

Twelve ⅛" OD additive (e.g., consumable supply) tubes 294 are attached to the outside of the nozzle body with the flavor ring. An additive (consumable) flows through each tube at a 20-degree angle 315 to the central axis of the nozzle through flow path 316. The ten additive tubes are arranged at equal angular intervals around the central axis of the nozzle. Each of the additive tubes is fed from a corresponding additive in a container in one of the positions in one of the slots of the machine. The radial distance 318 between the central axis 320 of the lower end 322 of each of the additive tubes and the central axis 324 of the nozzle is 0.4 inches. Other angular orientations of the tubes relative to the central axis of the nozzle could be used angles in the range of 10° to 30°) and other distances 318 could be used (for example in the range of 0.1 inches to 0.6 inches), the choice of the angular orientation and the distance is important to proper functioning of the nozzle, because if the angle is too large, the additive may over spray across the beverage stream and if the angle is too small, the additive may not integrate well with the other components of the beverage stream.

Because each of the twelve additives is delivered directly to the beverage stream at the nozzle, flavor crossover between successive dispensed beverages can be minimized. In other words different beverages (such as coffee and lime-flavored carbonated water) can be dispensed one after the other without crossover of flavors between the two. Combined with the ability to switch quickly between carbonated water, hot water, and chilled water, this feature of the delivery of the additives means that a wide variety of beverages can be dispensed in succession without crossover.

In some implementations, the nozzle can be provided with additional outlets for dispensing ready-to-drink beverages (such as beer, wine, kombucha, cold brewed coffee). These beverages would be dispensed through outlets other than the main outlet of the nozzle used for still, sparkling, and hot water.

In some examples, the delivery of additives can achieve a wide variety of concentration ratios (e.g., the ratio between the volume of water in a beverage and the volume of an additive such as a flavor). The concentration ratio determines the lightness or boldness of the flavor in the dispensed beverage. The achievable ratios on the lightness end of the spectrum can be extended beyond what might be achievable by running the concentrate pump at its minimum speed. In some implementations, the pump can be operated at its lowest continuous speed and its duty cycle (on period as a proportion of total period of operation) can be varied. For example, at the lowest pump speed, alternation between 0.02 seconds on and 0.02 seconds off (a 50% duty cycle) can be controlled by the machine or under instructions from the server.

Figure 21:
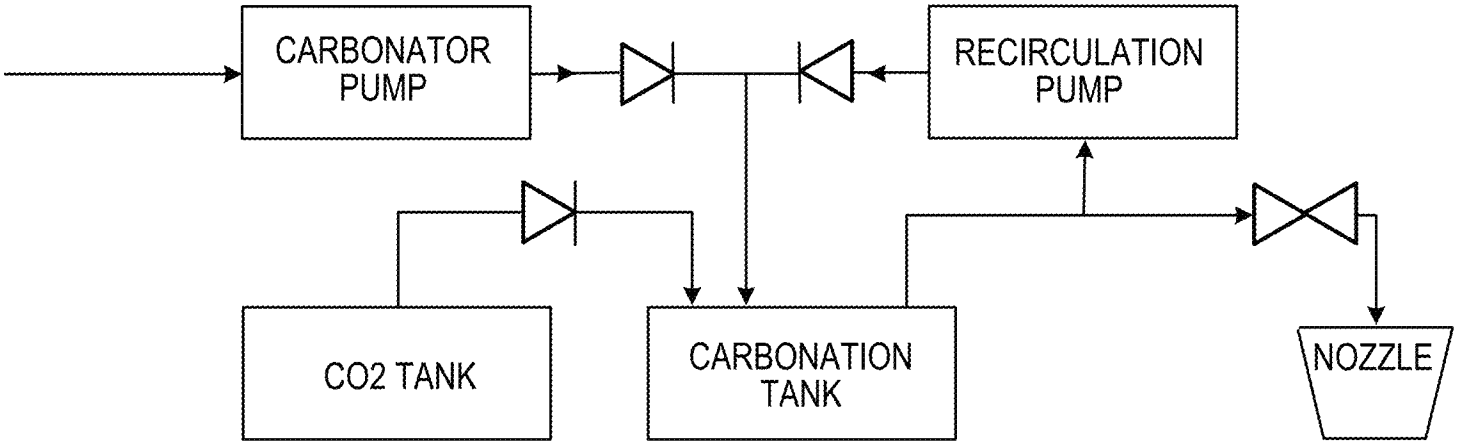

Returning to the carbonation sub-system as shown in FIG. 21, in operation water enters the carbonator pump and is pumped into the carbonation tank. The on or off state of the carbonation pump is controlled by a level sensor in the carbonation tank. CO2 flows from the CO2 tank to carbonation tank. The CO2 flow is controlled by a pressure regulator on the CO2 tank. CO2 and water mix in the carbonation tank. CO2 dissolves into the water in the carbonation tank. When the water level in the carbonation tank reaches the level sensor, the carbonation pump is turned off. The recirculation pump turns on. Water is drawn from the carbonation tank outlet and is pumped (recirculated) through the carbonation tank inlet. As more CO2 dissolves into the water, additional CO2 flows from CO2 tank into the carbonation tank. When operated, the recirculation pump runs for approximately 1 minute. The recirculation pump can run during beverage dispensing, without impacting the dispensing operation.

In more detail, water enters the carbonator pump through a ⅜" OD polyethylene tube. The carbonator pump is a 3-chamber diaphragm pump capable of moving 1.5 GPM at 150 PSI. The pump is powered by 120V AC 60 Hz. Water exits the carbonator pump and flows through a check valve to a 2-into-1 fitting. The 2-into-1 fitting has two inlets and one outlet. Check valves prevent water from back flowing through either of the inlets on the 2-into-1 fitting. From the outlet of the 2-into-1 fitting water flows into the carbonation tank. CO2 flows from the CO2 source, through a ¼"OD polyethylene tube. CO2 gas flows through a check valve into the carbonation tank. CO2 and water mix inside the carbonation tank to produce the carbonated water.

Carbonated water exits the recirculation pump through a ⅜" OD polyethylene tube, and flows through a check valve, back to the 2-into-1 fitting. From the 2-into-one fitting the water re-enters the carbonation tank, absorbing more CO2.

Operation of the recirculating carbonation sub-system control as follows. A level switch in the carbonation tank controls the carbonator pump. When the water level in the carbonation tank falls below a limit set by the level switch, the carbonator pump is turned on and pumps water into the carbonation tank. When the water level in the carbonation tank reaches a level that triggers the level switch, the carbonation pump is turned off. The recirculation pump is on whenever the carbonation pump turns on and remains on for 60 seconds after the carbonation pump turns off. If the recirculation sub-system is used with carbonation tanks holding other volumes of water, the time that the recirculation pump remains on after the carbonation pump turns off will be different.

The sequence of operations and flow of water and additives in the machine depend on choices made by the user through touch commands expressed on toggle sliders and the dispense button. These sequences do not include the operation of the water pump, which can be understood from other parts of our discussion.

In the following discussion, we refer to the following valves that control the operations and flows.

SV-1 chilled water solenoid valve
SV-2 low flow chilled water solenoid valve
SV-3 unchilled water solenoid valve
SV-4 hot water solenoid valve
SV-5 sparkling water solenoid valve
SV-6 source water inlet solenoid valve To dispense chilled still water, the following sequence occurs:

User adjusts "STYLE" toggle to "still" and "TEMPERATURE" toggle to "chilled"
User presses+holds dispense button
Solenoid valves SV-1 and SV-6 open immediately
User releases dispense button
Solenoid valve SV-1 closes immediately Solenoid valve SV-6 closes when the pressure transducer (measuring water pressure in the bladder tank) stops seeing a change in water pressure, which indicates that the bladder tank has refilled completely.

Figure 22:
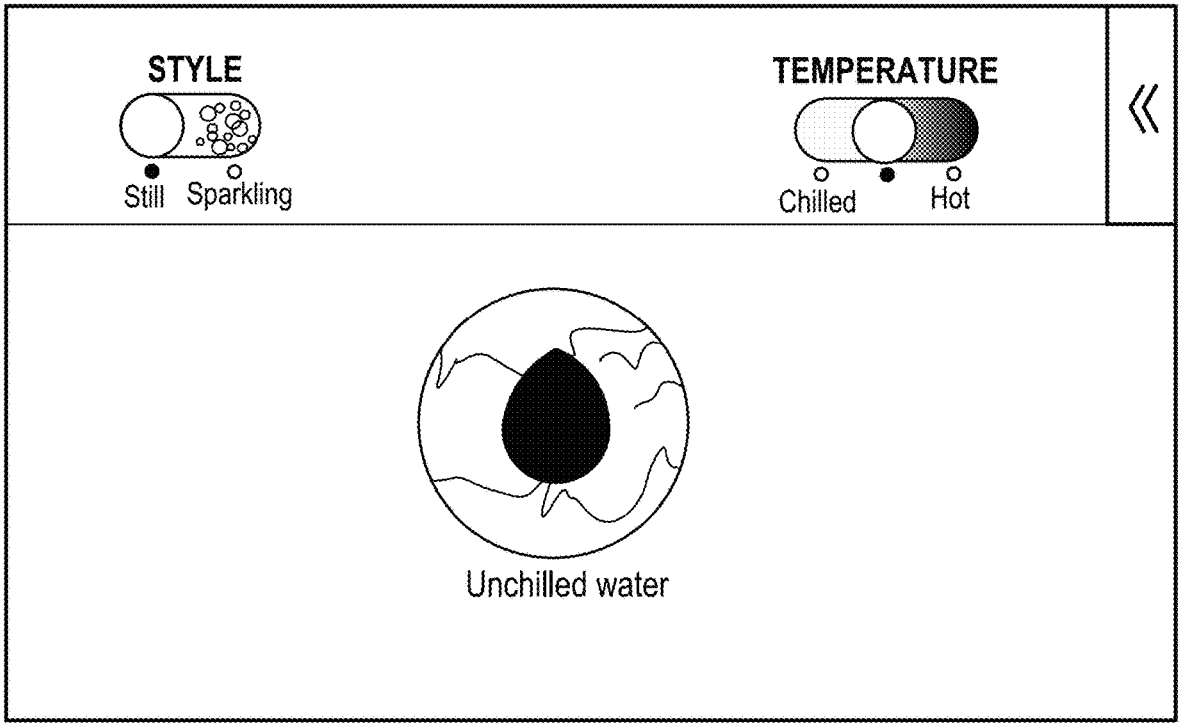

As shown in FIG. 22, to dispense unchilled still water, the following sequence occurs:

User adjusts "STYLE" toggle to "Still" and "TEMPERATURE" toggle to the center position User presses+holds dispense button Solenoid valves SV-3 and SV-6 open immediately User releases dispense button Solenoid valve SV-3 closes immediately Solenoid valve SV-6 closes when the pressure transducer (measuring water pressure in the bladder tank) stops seeing a change in water pressure, which indicates that the bladder tank has refilled completely.

Figure 23:
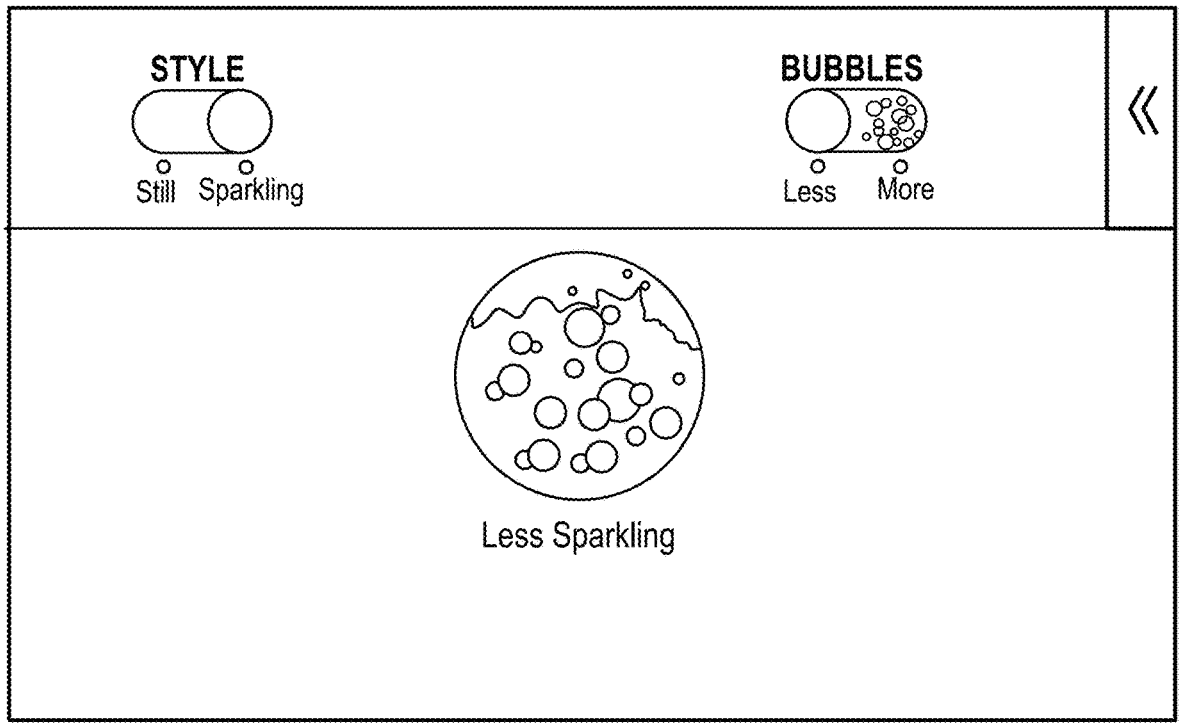

As shown in FIG. 23, to dispense less highly carbonated water, the following sequence occurs:

User adjusts "STYLE" toggle to "Sparkling" and "BUBBLES" toggle to "Less"

User presses+holds dispense button

Solenoid valve SV-2, SV-5, and SV-6 open immediately

User releases dispense button

Solenoid valves SV-2 and SV-5 close immediately

Solenoid valve SV-6 closes when the pressure transducer (measuring water pressure in the bladder tank) stops seeing a change in water pressure, which indicates that the bladder tank has refilled completely.

Figure 24:
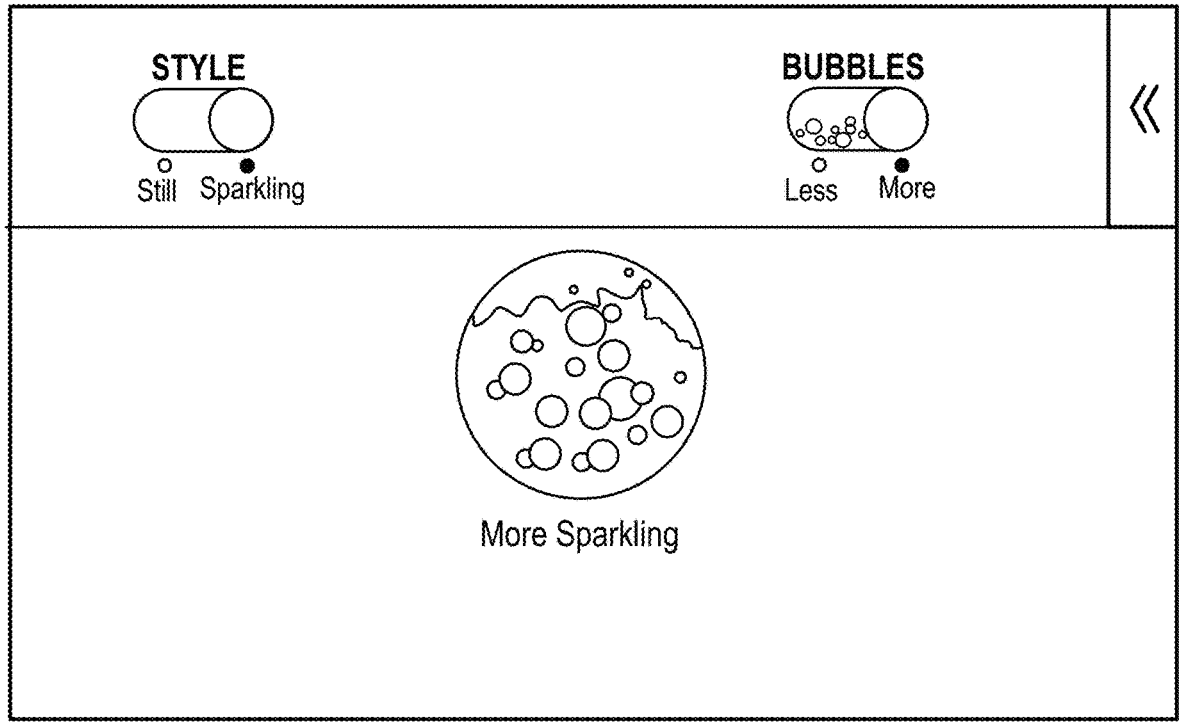

As shown in FIG. 24, to dispense more highly carbonated water, the following sequence occurs:

User adjusts "STYLE" toggle to "Sparkling" and "BUBBLES" toggle to "More"

User presses+holds dispense button

Solenoid valve SV-5, and SV-6 open immediately

User releases dispense button

Solenoid valve SV-5 closes immediately

Solenoid valve SV-6 closes when the pressure transducer (measuring water pressure in the bladder tank) stops seeing a change in water pressure, which indicates that the bladder tank has refilled completely.

Figure 25:
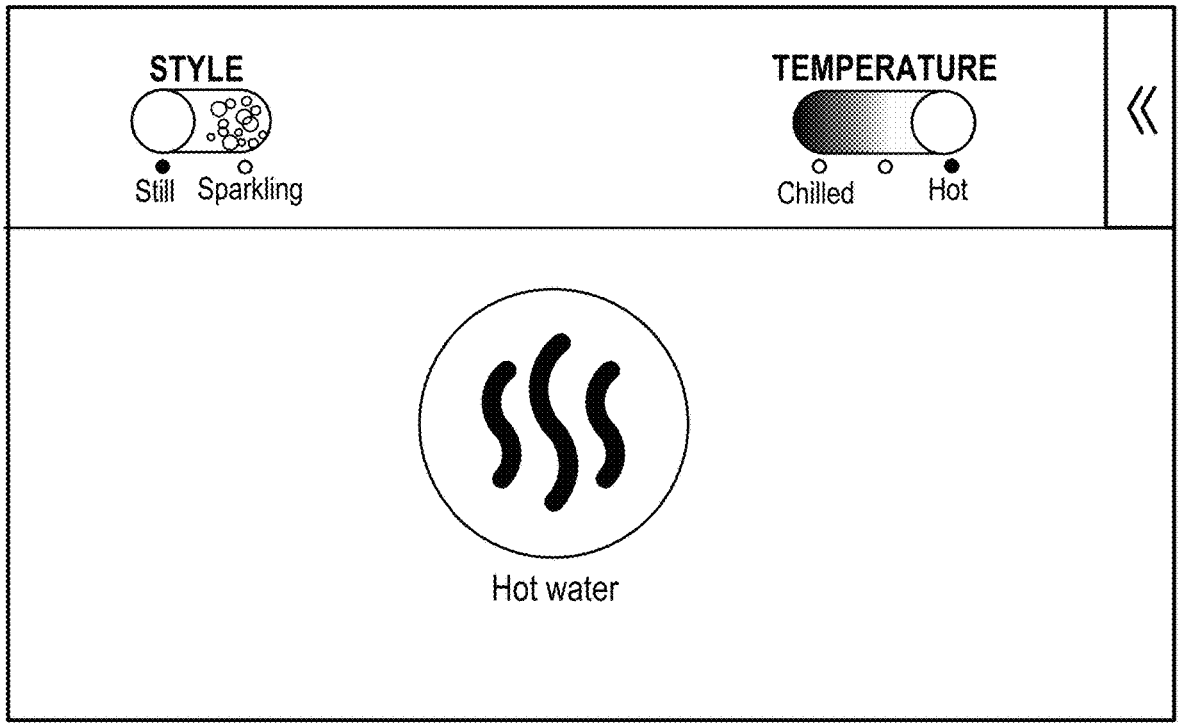

As shown in FIG. 25, to dispense hot water, the following sequence occurs:

User adjusts "STYLE" toggle to "Still" and "TEMPERATURE" toggle to "Hot"

User presses+holds dispense button

Solenoid valves SV-4 and SV-6 open immediately

User releases dispense button

Solenoid valve SV-4 closes immediately

Solenoid valve SV-6 closes when the pressure transducer (measuring water pressure in the bladder tank) stops seeing a change in water pressure, which indicates that the bladder tank has refilled completely.

Changing the rate of dispensing carbonated beverages changes the rate at which the CO2 tank becomes depleted. The machine can predict CO2 usage (and therefore when the tank will be depleted) based on a user (service technician) specified rate of dispensing carbonated beverages. Based on empirical data, it is possible to determine a relationship between the rate at which CO2 (mass/time units) is drawn from the CO2 tank and the rate at which beverages are being dispensed (in volume/time units) from the nozzle. Information about this relationship is stored in the memory of the base unit control board and used (together with the current set rate of beverage dispensing and the known initial volume of CO2 in a fresh CO2 tank) by processes executed by the base unit control board to determine the amount of CO2 remaining in the tank. When the CO2 tank approaches empty, the machine can alert a service technician at the machine or can transmit information wirelessly to a central location to alert a supplier of the need to replace the CO2 tank. This eliminates the need for (or can supplement the user of) a load cell that physically weighs the CO2 tank to track usage.

The machine also can determine when the water filter (a consumable) needs to be replaced. For this purpose, a pressure transducer 330 communicates with the water in the bladder tank. The base unit control board monitors the time needed, after a beverage is dispensed, for the water pressure at the bladder tank (which is positioned after the water filter in the fluid flow path) to return to its level prior to the dispensing. The value of this time period can be used to determine the level of consumption of the water filter. As the filter becomes consumed it will take longer to replenish the reservoir and for the pressure level to recover.

The machine also can use the same pressure transducer in the bladder tank to detect a leak and respond (e.g., notify a central server, shut off the water supply to the machine, display an "out of order" screen, or take some other step). If, based on signals from the pressure transducer, the base unit control board detects a drop in water pressure when the machine is not dispensing beverages or is not replenishing the bladder tank, it determines that a leak is occurring.

The bottom portions of the external skin of the machine are designed to form a two-inch deep watertight tray. A sensor (e.g., float switch) 332 is located in the base of the machine. If a leak occurs water will accumulate in the base of the machine, and trigger the sensor. When the base unit control board determined that the sensor has been triggered the machine will stop all beverage dispensing, close the solenoid at the machine's water inlet, and notify a server, via an Internet connection that a leak has occurred. A drain plug on the bottom face of the machine, along the front edge, is used to drain water from the base of the machine after a leak has been repaired.

In some implementations, each machine communicates with a central server to send information about the state and operation of the machine and receives information and instructions related to its state and operation.

The central server includes one or more processors and databases and stored instructions executable by the processor to provide a wide variety of functions including analysis of information provided by the machines, application of machine learning to data in the database, development of strategies for operation of the machines and use and replenishment of consumable supplies, to name a few. The central server also serves a dashboard to administrative users of the server. The dashboard reports information about the states and operations of the machines and receives instructions and queries presented by the administrative users.

Figure 14:
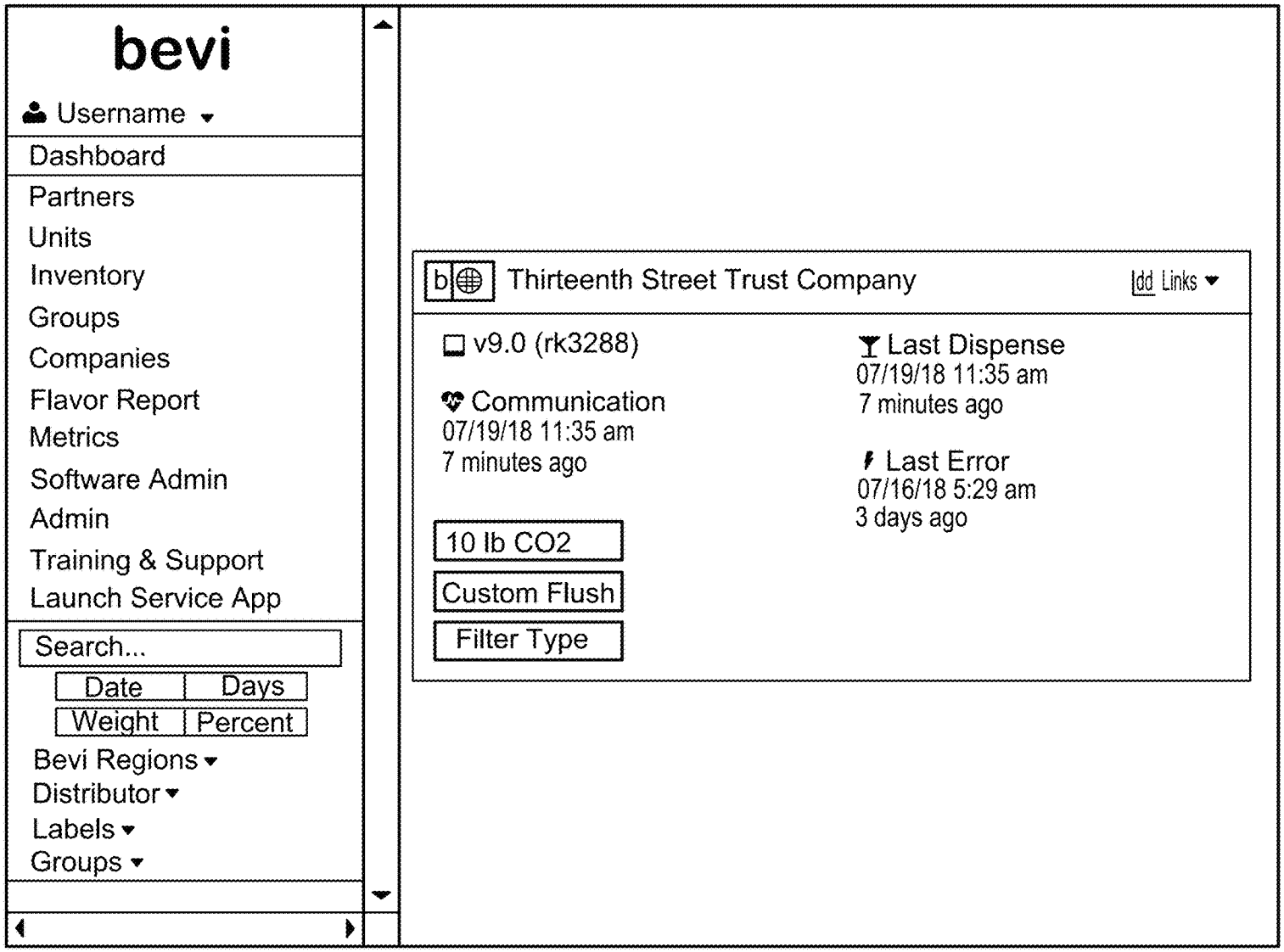

As shown at the left side of FIG. 14, a user interface provided by the server enables administrative users to review information about partner companies, machines (units) covered by the server, inventories of consumable supplies, groupings of machines, companies who use the machines, reports on consumable supplies (e.g., flavors), metrics, and perform other actions. The user interface also enables administrative users to invoke a dashboard tab to show the dashboard.

As shown in the right side of FIG. 14, the dashboard contains panels each of which is associated with a company at which machines are in use. Multiple panels can be shown on a single screen and by scrolling the administrative user can view any of the panels being managed by the server.

A given panel shows the name of the company, the version of the machines being used, the most recent communication received from the machine, the most recent dispensing of a beverage, and the most recent error. At the lower left of each panel, items are posted identifying components of the machine such as the weight capacity of the CO2 tank, the version of nozzle, or the brand of water filter.

The dashboard provides a number of tabs (shown in the navigation bar on the left side of FIG. 14) that can be invoked by an authorized administrative user.

The navigation bar allows users to view different sections of the dashboard by selecting a corresponding tab. The navigation bar also allows an end user to search for a machine unit by name, to sort machines in a given listing by selected categories, toggle dashboard displays of date/days for parameters related to time, and toggle dashboard displays of weight/percent for parameters related to usage of consumable supplies.

The dashboard tab (a portion of which is shown in FIG. 14) displays the status of each machine including information such as an identification of the machine, a version of the software used by the machine, a conductivity status, a time of the most recent dispensing of a beverage controlled by an end-user, a time of the most recent system error communicated from the machine, labels for specific machine features, and icons indicating the location of the machine and a party responsible for servicing the machine.

The partners tab lists information on third parties responsible for servicing each of the machines. The data for the records shown on the partners tab includes the partner company name, the geographical region of the machine, the number of machines serviced (e.g., owned) by the partner, the installation status of the machines (e.g., installed or retired), the number of machines and inventory of the partner, and the identification numbers of the machines.

The units tab lists information about each of the machines (which we sometimes also call units). The data can include an identifier of the machine, the partner servicing the machine, the company name of the customer where the end-users are employed, the status of the machine (installer or retired), the installation date, a number of bottles of beverages saved by use of the machine (e.g., for all time, four-year-to-date, or weekly), a weekly percentage change in the number of bottles saved, a percentage of usage of each available type of beverage (e.g., still water, sparkling water, flavored still water, and sparkling flavored water), a percentage of usage of each flavor, and android ID number, flow rates for still in sparkling water, and the threshold for the filter alert in gallons.

The inventory tab shows information for each machine held in an inventory of a servicing partner, including a machine identification, a name of the servicing partner, a next service date based on tracking of consumable supplies, aspects of the status of the machine (including Internet connection, CO2 supply, labels for special status of the machine, and identification of groups that include the machine.

The groups tab displays groups of machines defined by administrative users to categorize the machines for reporting purposes. The groups tab enables the user to search through defined groups of machines, add or remove machines from existing groups, and add or remove groups.

The companies tab shows the company names of customers where end-users are located in information about those companies including, for example, the name of the customer, a number of bottles saved by the customer for the past year, the number of bottles saved by the customer overall time, the number of active machines operated by the customer, the total number of machines of the customer, and a list of the machines related to the customer.

The flavor report tab displays information about each flavor (or other consumable supply) across all machines. The flavor report can include, for example, the popularity of the flavor, the number of machines in which the flavor is installed, in general usage data related to the flavors.

The metrics tab displays summaries of usage data, including, for example, data about beverage dispensing that occurred over a previous period, such as the prior hour, and the total number of machines.

The software administrator tab enables the generation of reports based on data tracked by the dashboard, includes resources to manage the dashboard, and includes links to external resources on which the dashboard data depends.

An administrative tab lists administrative users that have access to the dashboard, including their names and email addresses.

The training and support tab displays technical support and training assets including instructional videos, machine servicing guides, and frequently asked questions.

The launch service application allows an administrative user to log service visit transactions and permits a search of all covered machines and enables logging or editing of all service visits.

The server can use the data fed from the machines into the database for a wide variety of purposes including the following.

The server can monitor and report through the dashboard, when and by whom any of the machines has been serviced and what changes or adjustments were made during the service. The server either on its own initiative or under the guidance of an administrative user can adjust a wide variety of operating parameters for the machine, including temperature set points, rates of beverage dispensing and others. In particular the following parameters can be adjusted remotely from the server for any of the machines covered by the server:

1. The ice bath temperature set point and the hysteresis temperature band for the ice bath.

2. A time out period for operation of the water pump. This protects the pump from running dry when the machine is calling for water, causing the pump to run, but water is not available. The time out period also protects the machine in case a leak or other problem would cause the inlet valve to time out. This can occur when the inlet valve opens to admit water in response to an initiation of a dispensing of a beverage. The solenoid valve stays open as the water pressure rises after the beverage is dispensed to refill the bladder tank.

3. A preset threshold for closing the inlet valve when a pressure sensor signal. The preset threshold is a value for a time based rate of change in the machine water pressure.

4. A water filter consumption threshold. The threshold is a value of a ratio of the time to refill the bladder tank after a beverage is dispensed and the time to dispense the beverage. As the water filter is consumed, the ratio increases. The threshold is chosen to represent a ratio when the filter is considered to be fully consumed. The ratio and the exceeding of the threshold can be monitored at the server and used to schedule replacement of the water filter during a service visit. The threshold value also can be adjusted remotely by an administrative user from the server.

5. A leak detection threshold as a value of water pressure below which the machine is considered to have a water leak, assuming that the machine is not then dispensing a beverage. The machine can report the water leak to the server.

6. A water supply shut off detection threshold as a value of water pressure, measured while a beverage is being dispensed, below which the machine is determined to have a shut off water supply or a water supply of insufficient flow.

7. An additive to water ratio for each additive (e.g., flavor). The peristaltic pump associated with each of the consumable supplies is controlled to deliver a precise amount of the supply during the dispensing of a beverage. Additives that are concentrates are delivered in amounts that represent appropriate dilutions when mixed with water being dispensed. The value of the additive-to-water ratio determines the pumped flow rate of the consumable supply relative to the flow rate of the water. The correct ratio depends on the identity of the additive and its formulation.

8. The machine can be started remotely by instructions from the server.

9. The frequency with which each sensor reading (e.g., pressure or temperature) is sampled or sent to the server can be specified from the server.

10. Instructions can be sent from the server to control specific operations of components of the machine such as enabling or disabling the water pump, the ice bank agitator, the chiller, the inlet solenoid, the RFID antennas, or combinations of them.

11. The server can update software and firmware of the machine remotely.

12. A CO2 depletion threshold can be set. If a beverage is dispensed with carbonated water and the level switch in the carbonation tank does not call for water, the machine reports that the CO2 supply has been depleted. The depletion threshold is an amount of time during which a dispensing of a beverage has begun but no call for water has been made from the carbonation tank.

13. A water pump start-and-end delay amount can be set. The machine is set to have a certain delay between the opening of the dispensing solenoid in the turning on of the water pump when a beverage is to be dispensed. The machine is also said to have a certain delay between the turning off of the water pump at the end of the beverage dispensing and the closing of the dispensing solenoid. Each of these delays can be set from the server.

14. The frequency with which RFID information is polled can be set from the server.

15. Operating parameters are sent from the machine to the server and then reported on the dashboard of the server. The frequency with which operating parameters are sent to the dashboard can be controlled of the server.

16. A consumable supply pump pulsing rate can be set to pulse the pump to reduce the amount of the supply that is delivered, below the minimum constant-speed reading of the pump.

In addition to setting various parameters as described above, the server can control the monitoring of machine performance by sensors on the machine and the raising of alarms based on the data collected from the sensors. Among the data gathered are the following:

1. Machine water pressure.

2. The amount of time required to refill the carbonation tank after a beverage has been dispensed, that is, the ratio of the beverage dispensing time to the carbonation tank refill time.

3. The amount of time to refill the bladder tank after a beverage has been dispensed, that is, the ratio of the beverage dispensing time to the bladder tank refill time.

4. The ice bath temperature.

5. The duty cycle of the chiller.

6. The duration and reason for opening of the water inlet. The duration can be when a beverage is being dispensed or after a beverage has been dispensed.

7. The time period required for the water pump to refill the carbonation tank.

8. Information on machine performance and usage for use in future design work.

9. Information useful to diagnose remote machine failures.

Among the alarms that can be triggered by the server based on the performance or state of the machine are the following, each of which can indicate a need for service or preventative maintenance:

1. Detection of a leak within the machine.

2. Low water pressure.

3. Depletion of the CO2 consumable supply.

4. The filter having reached the end of its useful life.

Also, the server can monitor consumption of consumable supplies in the machine and analyze the information for a wide variety of purposes including the following:

1. The server can protect when a consumable supply in a machine will need to be replaced or refilled by applying a predictive model to the information about the consumption of consumable supplies across a large number of machines. The information about the consumption of consumable supplies could include, for example, historical selections of carbonation strength in dispensed beverages.

2. The server can analyze trends of preferences of end-users for types of beverages. For example, the server can aggregate usage data across all machines being covered by the server, or groups of machines based on geography, for example. Based on the aggregated data, the server can determine rates of consumption for each kind of consumable supply (e.g., flavor). The consumption rates can then be used to forecast when orders should be placed to replenish inventories of consumable supplies. The forecast orders can also be based on minimum order quantity, quantity on hand, and lead time. Machines can be grouped by region or period of time, which enables the server to optimize orders to suppliers.

3. The server can also predict the behavior of end-users with respect to usage of consumable supplies. The prediction can be based on accumulated data that records, for each beverage dispensed at each machine, a time and date of the dispensing and what type of beverage in which consumable supplies were used for dispensing the beverage. Analysis of this information can produce data about the relative popularity of different consumable supplies, correlations between preferences for consumable supplies, the seasonality of preferences, and the region alley of preferences. The raw data can be applied to predictive models useful in developing new consumable supplies and in a manner, timing, and extent of offering of respective consumable supplies to end-users. As a result, consumable supplies can be marketed to end-users that are expected to be attractive to them.

The server also can use its communication arrangements with covered machines to remotely control the operations of the machines. The controls can include turning on and off functionality of a machine based on a selection of a beverage to be dispensed. Access to the machine can be controlled remotely including locking and unlocking for service activities, changing a PIN access code remotely (for example when a service employee departs), updating of the user interface and the beverage dispensing software, and changing property specific to the timing or parameter thresholds (e.g., the amount of time for water flush after a beverage dispensed.

Each machine itself is capable of altering settings, changing its own state, and changing its own operations based on information acquired from sensors at the machine, information and instructions received from the server, and other factors.

For example, the machine can change beverage options presented to end-users on the user interface based on information about the consumable supplies in the machine. The options presented can reflect the identity of the consumable supplies (e.g., flavors) that are installed in the machine and available for dispensing, the availability of hot water, the availability of CO2 for carbonation, rules about which consumable supplies may be added to hot water, to cold water, or to sparkling water, rules about which consumable supplies can be dispensed without the addition of water, rules about combinations of two or more consumable supplies that can be included in a given beverage, and dispense rate settings (default, strong, light, and others).

Each machine has a local lookup table in a local storage location. When a new consumable supply is added to a machine, the local application reads the information on the consumable container and uses the lookup table to identify the consumable supply, including a flavor ID, flavor name, a flavor icon, a concentrate-dispense ratio, a user interface color, servicing name, a nutrition label content, ingredients, a volume of the container, inactive or discontinued status, await, shelf life, multiple language options for the name, and ingredients. The machine can then use this information in controlling its own state, operation, user interface displays, and other features.

Based on information about the consumable supplies installed and available at the machine, the machine can change options presented to the user and operational settings (e.g., the possible mixtures and ratios for beverages to be dispensed). The presented options can, for example, be based on the remaining amounts of various consumable supplies in the machine. For example, if the machine is designed to hold for consumable supplies, and one of the consumable supplies is depleted, the icon display for that supply could be removed from the touch screen or replaced by an icon for a flavor that is a combination of two of the remaining available consumable supplies.

Also, statistical analysis at the server can determine that consumable supplies are more or less likely to be used in dispensed beverages based on the locations of the corresponding icons in a touchscreen. For example, flavors having icons located at the top left of the touchscreen tend to be dispensed more often than flavors having icons on the bottom left of the touchscreen. The machine, or the server, could recalibrate frequently (such as each day) to display on the icon that is least likely to be invoked the consumable supply that is nearest to depletion and to display on the icon that is most likely to be invoked the consumable supply that is least likely to be depleted. Other similar arrangements would be possible.

Other implementations are also within the scope of the following claims.

The invention claimed is:

1. A method comprising setting a flow rate at which carbonated beverages are dispensed at a beverage dispenser, wherein adjusting the flow rate changes a rate at which a CO2 tank becomes depleted, determining a volume of carbonated beverages dispensed from the beverage dispenser beginning at a predetermined time based on the flow rate, and determining a relationship between a first rate at which CO2 is drawn from the CO2 tank and a second rate at which beverages are dispensed from a nozzle, based on the determined volume of carbonated beverages dispensed, determining a fill level of the CO2 tank from which CO2 is drawn for carbonating the beverages dispensed at the beverage dispenser.

2. The method of claim 1 in which the fill level is determined based on an empirically determined relationship between the flow rate at which the carbonated beverages are dispensed and the rate at which CO2 is drawn from the CO2 tank.

3. A method comprising detecting when a dispensing of a beverage has ended, detecting how long after the end of the dispensing it takes for a reservoir of water used in the dispensing of the beverage to be replenished by detecting changes in water pressure in a supply of water, and based on how long it takes for the reservoir of water to be replenished, determining a consumption state of a filter through which the water passes before being used in the dispensing of the beverage.

4. The method of claim 1, further comprising:

determining a water level in a carbonation tank reaches a level of a sensor; and in response to the water level reaching the level of the sensor, disabling a carbonation pump.

5. The method of claim 4, wherein CO2 flows from the CO2 tank to the carbonation tank and the CO2 and water mix in the carbonation tank.

6. The method of claim 4, wherein CO2 flows through a check valve into the carbonation tank.

7. The method of claim 1, further comprising in response to the fill level of the CO2 tank being below a predefined threshold, generate an alert to indicate the CO2 tank needs replacing.

8. The method of claim 7, further comprising transmitting the alert to a central location a supplier of a need to replace the CO2 tank.

9. The method of claim 1, further comprising storing information about the relationship in a memory.

10. The method of claim 1, wherein determining the fill level of the CO2 tank is further based on the relationship between the rate and the second rate.

11. The method of claim 3, further comprising determining how long it takes to achieve a predetermined pressure on a downstream side of the filter based on a pressure sensor.

12. The method of claim 1, wherein the pressure is measured at a location along a path between the filter and a bladder tank.

13. The method of claim 1, wherein the pressure sensor is mounted on a bladder tank.

* * * * *